US009163493B2

(12) United States Patent
Kumbhar et al.

(10) Patent No.: US 9,163,493 B2
(45) Date of Patent: Oct. 20, 2015

(54) WELLBORE SERVICING ASSEMBLIES AND METHODS OF USING THE SAME

(71) Applicant: Halliburton Energy Services, Inc., Houston, TX (US)

(72) Inventors: Koustubh Dnyaneshwar Kumbhar, Pune (IN); Bharat Bajirao Pawar, Pune (IN); Yogesh Kamalakar Deshpande, Pune (IN); Robert Brice Patterson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 427 days.

(21) Appl. No.: 13/729,181

(22) Filed: Dec. 28, 2012

(65) Prior Publication Data

US 2014/0182849 A1 Jul. 3, 2014

(51) Int. Cl.

| | |
|---|---|
| ***E21B 43/26*** | (2006.01) |
| ***E21B 43/25*** | (2006.01) |
| ***E21B 23/00*** | (2006.01) |
| ***E21B 34/12*** | (2006.01) |
| ***E21B 43/114*** | (2006.01) |

(52) U.S. Cl.

CPC ..... *E21B 43/25* (2013.01); *E21B 23/006* (2013.01); *E21B 34/12* (2013.01); *E21B 43/114* (2013.01); *E21B 43/26* (2013.01)

(58) Field of Classification Search

USPC ..... 166/305.1, 307, 308.1, 334.1, 331, 166/332.1, 332.3

See application file for complete search history.

(56) References Cited

U.S. PATENT DOCUMENTS

| | | | | |
|---|---|---|---|---|
| 2,222,750 | A | 11/1940 | Litolff | |
| 5,335,724 | A | 8/1994 | Venditto et al. | |
| 5,396,953 | A | 3/1995 | Holder et al. | |
| 5,609,178 | A | 3/1997 | Hennig et al. | |
| 6,883,610 | B2 | 4/2005 | Depiak | |
| 7,051,812 | B2 * | 5/2006 | McKee et al. | 166/305.1 |
| 7,159,660 | B2 | 1/2007 | Justus | |

(Continued)

FOREIGN PATENT DOCUMENTS

| | | | |
|---|---|---|---|
| EP | 0427422 | A2 | 5/1991 |
| GB | 2391239 | A | 2/2004 |

(Continued)

OTHER PUBLICATIONS

Filing receipt and specification for patent application entitled "Wellbore Servicing Assemblies and Methods of Using the Same," by Robert Brice Patterson, et al., filed Jul. 9, 2012 as U.S. Appl. No. 13/544,750.

(Continued)

*Primary Examiner* — Sean Andrish

(74) *Attorney, Agent, or Firm* — Haynes and Boone, LLP

(57) ABSTRACT

A wellbore servicing system comprising a casing string disposed within a wellbore, a work string at least partially disposed within the casing string and having a wellbore servicing tool incorporated therein, wherein the wellbore servicing tool is selectively transitionable between a jetting configuration and a mixing configuration, wherein the wellbore servicing tool is configured to transition between the jetting configuration and the mixing configuration via contact between the wellbore servicing tool and the casing upon movement of the work string upwardly within the casing string, upon movement of the work string downwardly within the casing string, or by combinations thereof.

19 Claims, 9 Drawing Sheets

(56) References Cited

U.S. PATENT DOCUMENTS

| | | | |
|---|---|---|---|
| 7,234,529 | B2 | 6/2007 | Surjaatmadja |
| 7,681,654 | B1 | 3/2010 | Cugnet |
| 7,775,285 | B2 | 8/2010 | Surjaatmadja et al. |
| 7,849,924 | B2 | 12/2010 | Surjaatmadja et al. |
| 8,104,539 | B2 | 1/2012 | Stanojcic et al. |
| 2007/0051521 | A1 | 3/2007 | Fike et al. |
| 2007/0102156 | A1 | 5/2007 | Nguyen et al. |
| 2007/0284106 | A1 | 12/2007 | Kalman et al. |
| 2009/0159299 | A1 | 6/2009 | Kratochvil et al. |
| 2010/0044041 | A1 | 2/2010 | Smith et al. |
| 2011/0067870 | A1 | 3/2011 | East, Jr. |
| 2012/0205108 | A1 | 8/2012 | Stang |
| 2013/0180721 | A1 | 7/2013 | Getzlaf et al. |
| 2013/0213655 | A1 | 8/2013 | Martinez |
| 2013/0299173 | A1 | 11/2013 | Stromquist et al. |
| 2014/0008071 | A1 | 1/2014 | Patterson et al. |

FOREIGN PATENT DOCUMENTS

| | | | |
|---|---|---|---|
| GB | 2398585 | A | 8/2004 |
| WO | 2008142409 | A1 | 11/2008 |
| WO | 2014011361 | A2 | 1/2014 |
| WO | 2014105445 | A2 | 7/2014 |

OTHER PUBLICATIONS

Office Action dated Aug. 18, 2014 (35 pages), U.S. Appl. No. 13/544,750, filed Jul. 9, 2012.

Schlumberger Oilfield Glossary definition of "J-slot," downloaded from Internet on Aug. 13, 2014, www.glossary.oilfield.slb.com, 1 page.

Schlumberger Oilfield Glossary definition of "perforate," downloaded from Internet on Aug. 13, 2014, www.glossary.oilfield.slb.com, 1 page.

Schlumberger Oilfield Glossary definition of "perforation," downloaded from Internet on Aug. 13, 2014, www.glossary.oilfield.slb.com, 1 page.

Schlumberger Oilfield Glossary definition of "staged fracturing," downloaded from Internet on Aug. 13, 2014, www.glossary.oilfield.slb.com, 1 page.

Foreign communication from a related counterpart application—International Search Report and Written Opinion, PCT/US2013/074737, Oct. 24, 2014, 10 pages.

Foreign communication from a related counterpart application—International Search Report and Written Opinion, PCT/US2013/046127, Feb. 28, 2014, 12 pages.

* cited by examiner

WELLBORE SERVICING ASSEMBLIES AND METHODS OF USING THE SAME

CROSS-REFERENCE TO RELATED APPLICATIONS

Not applicable.

STATEMENT REGARDING FEDERALLY SPONSORED

Not applicable.

RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

In some wells, it may be desirable to individually and selectively create multiple fractures along a wellbore at a distance apart from each other, creating multiple "pay zones." The multiple fractures should have adequate conductivity, so that the greatest possible quantity of hydrocarbons in an oil and gas reservoir can be drained/produced into the wellbore.

As part of a formation stimulation process, one or more perforations may be introduced into a casing string, a cement sheath surround a casing string, the formation, or combinations thereof, for example, for the purpose of allowing fluid communication into the formation and/or a zone thereof. For example, such perforations may be introduced via fluid jetting operation where a fluid is introduced at a pressure suitable to form perforations in the casing string, cement sheath, and/or formation. In addition, a formation stimulation process might further involve a hydraulic fracturing operation in which one or more fractures are introduced into the formation via the previously formed perforations. Such a formation stimulation procedure may create and/or extend one or more flowpaths into the wellbore from the stimulated formation and thereby increase the movement of hydrocarbons from the fractured formation into the wellbore.

Such a stimulation operation either necessitates the placement and removal of wellbore servicing tools configured for each of the perforating (also referred to herein as jetting) and fracturing (also referred to herein as mixing) operations and/or reconfiguring a suitable wellbore servicing tool between a perforating configuration and a fracturing operation. However, many conventional servicing tools require that an obturating member (e.g., a ball, dart, etc.) be pumped down to the wellbore servicing tool from the surface (e.g., "run-in") and/or reversed out of the wellbore (e.g., "run-out") in order to accomplish such reconfigurations. Either scenario results in a great deal of lost time and usage of wellbore servicing fluids, and, thus increased expense for the stimulation process. In addition, such conventional wellbore servicing tools are subject to wear and erosion, potentially resulting in the failure of the wellbore servicing tool to transition between the perforating and fracturing configurations.

As such, there exists a need for an improved downhole wellbore servicing tool.

SUMMARY

Disclosed herein is a wellbore servicing system comprising a casing string disposed within a wellbore, a work string at least partially disposed within the casing string and having a wellbore servicing tool incorporated therein, wherein the wellbore servicing tool is selectively transitionable between a jetting configuration and a mixing configuration, wherein the wellbore servicing tool is configured to transition between the jetting configuration and the mixing configuration via contact between the wellbore servicing tool and the casing upon movement of the work string upwardly within the casing string, upon movement of the work string downwardly within the casing string, or by combinations thereof.

Also disclosed herein is a wellbore servicing tool comprising a housing generally defining an axial flowbore and comprising one or more high-pressure ports, and one or more low-pressure ports, a mandrel slidably positioned within the housing, and one or more drag block assemblies, wherein the one or more drag block assemblies are configured to impart longitudinal movement to the mandrel via contact with a wellbore or casing surface, wherein, when the wellbore servicing tool is in a jetting configuration, the mandrel blocks a route of fluid communication via the one or more low-pressure ports, wherein, when the wellbore servicing tool is in a mixing configuration, the mandrel does not block the route of fluid communication via the one or more low-pressure ports, and wherein the wellbore servicing tool is configured to transition between the jetting configuration and the mixing configuration upon upward movement of the housing relative to the casing string, upon downward movement of the housing relative to the casing string, or by combinations thereof.

Further disclosed herein is a wellbore servicing method comprising positioning a work string having a wellbore servicing tool incorporated therein within a casing string disposed within a wellbore, wherein the work string is positioned such that the wellbore servicing tool is proximate to a first subterranean formation zone, configuring the wellbore servicing tool via contact with the casing string to deliver a jetting fluid, wherein configuring the wellbore servicing tool comprises moving the work string upwardly with respect to the casing, moving the work string downwardly with respect to the casing, or combinations thereof, communicating the jetting fluid via the wellbore servicing tool, configuring the wellbore servicing tool via contact with the casing string to deliver at least a portion of a fracturing fluid, wherein configuring the wellbore servicing tool comprises moving the work string upwardly with respect to the casing, moving the work string downwardly with respect to the casing, or combinations thereof, and communicating at least a portion of the fracturing fluid via the wellbore servicing tool.

Further disclosed herein is a wellbore servicing system comprising a casing string disposed within a wellbore, a work string at least partially disposed within the casing string and having a wellbore servicing tool incorporated therein, wherein the wellbore servicing tool comprises a housing generally defining an axial flowbore and comprising one or more high-pressure ports, and one or more low-pressure ports, a mandrel slidably positioned within the housing, and one or more drag block assemblies contacting an inner bore surface of the casing string, wherein the one or more drag block imparts longitudinal movement to the mandrel, wherein, when the wellbore servicing tool is in a jetting configuration, the mandrel blocks a route of fluid communication via the one or more low-pressure ports, wherein, when the wellbore servicing tool is in a mixing configuration, the mandrel does not block the route of fluid communication via the one or more low-pressure ports, and wherein the wellbore servicing tool transitions between the jetting configuration and the mixing configuration upon upward movement of the housing relative to the casing string, upon downward movement of the housing relative to the casing string, or by combinations thereof.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
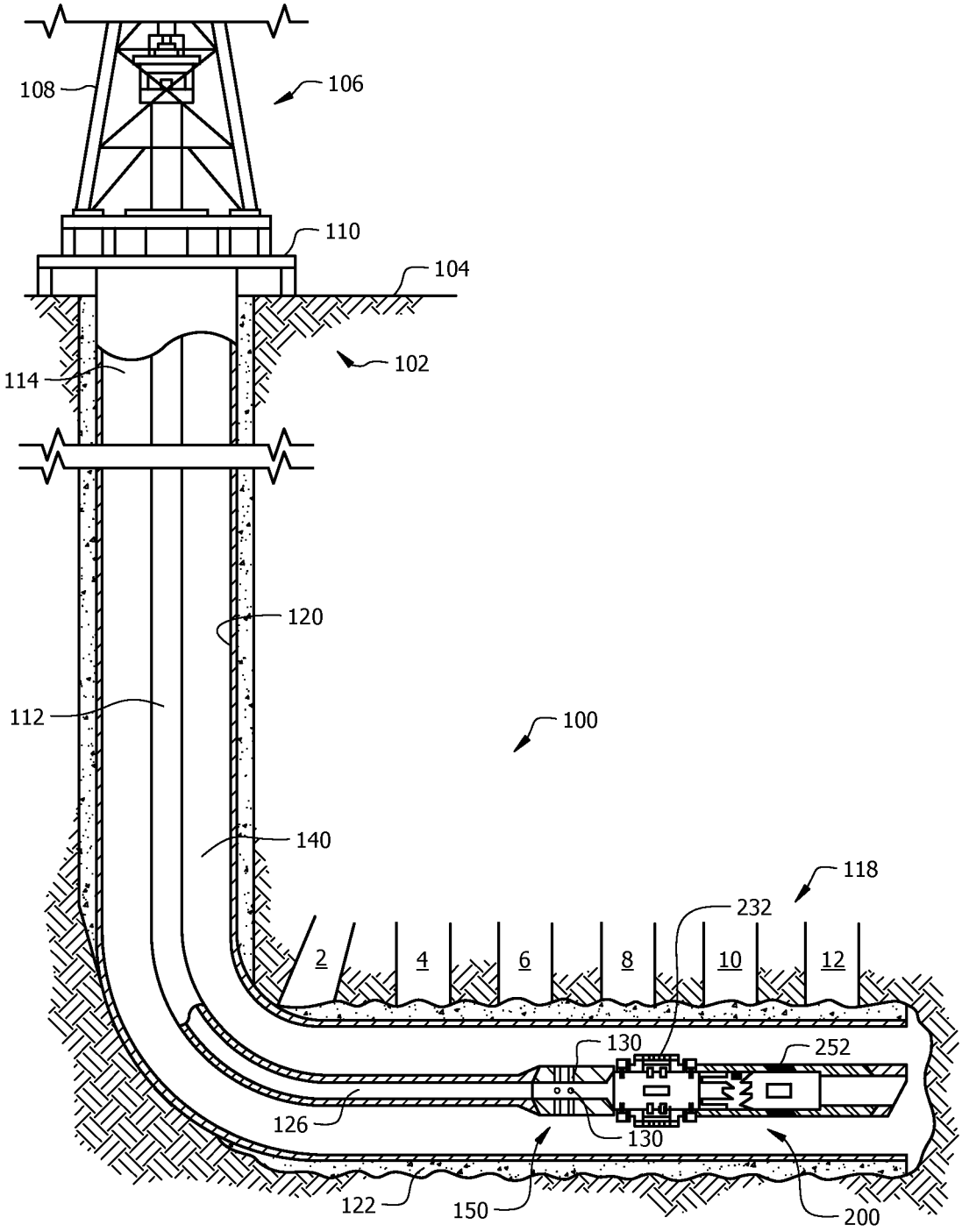
FIG. 1 is a simplified cutaway view of a wellbore servicing apparatus in an operating environment.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems, and methods of using the same. Particularly, disclosed herein are one or more embodiments of a wellbore servicing system comprising a wellbore servicing apparatus, as will be disclosed herein, configured to be selectively transitioned between a configuration suitable for the performance a perforating operation (e.g., a jetting operation) and a configuration suitable for the performance of a fracturing operation (e.g., a mixing/pumping operation) without transmitting obturating and/or signaling members into and/or out of the wellbore.

Referring to FIG. 1, an embodiment of an operating environment in which a wellbore servicing apparatus and/or system may be employed is illustrated. It is noted that although some of the figures may exemplify horizontal or vertical wellbores, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

As depicted in FIG. 1, the operating environment generally comprises a wellbore 114 that penetrates a subterranean formation 102 comprising a plurality of formation zones 2, 4, 6, 8, 10 and 12 for the purpose of recovering hydrocarbons, storing hydrocarbons, disposing of carbon dioxide, or the like. Wellbore 114 may be drilled into the subterranean formation 102 using any suitable drilling technique. In an embodiment, a drilling or servicing rig 106 disposed at the surface 104 comprises a derrick 108 with a rig floor 110 through which a work string 112 (e.g., a drill string, a tool string, a segmented tubing string, a jointed tubing string, or any other suitable conveyance, or combinations thereof) generally defining an axial flowbore 126 may be positioned within or partially within wellbore 114. In an embodiment, such a work string 112 may comprise two or more concentrically positioned strings of pipe or tubing (e.g., a first work string may be positioned within a second work string). The drilling or servicing rig may be conventional and may comprise a motor driven winch and other associated equipment for lowering the work string into wellbore 114. Alternatively, a mobile workover rig, a wellbore servicing unit (e.g., coiled tubing units), or the like may be used to lower the work string into the wellbore 114. In such an embodiment, the work string may be utilized in drilling, stimulating, completing, or otherwise servicing the wellbore, or combinations thereof.

Wellbore 114 may extend substantially vertically away from the earth's surface over a vertical wellbore portion, or may deviate at any angle from the earth's surface 104 over a deviated or horizontal wellbore portion 118. In alternative operating environments, portions or substantially all of wellbore 114 may be vertical, deviated, horizontal, and/or curved and such wellbore may be cased, uncased, or combinations thereof. In some instances, at least a portion of the wellbore 114 may be lined with a casing 120 that is secured into position against the formation 102 in a conventional manner using cement 122. In this embodiment, deviated wellbore portion 118 includes casing 120. However, in alternative operating environments, the wellbore 114 may be partially cased and cemented thereby resulting in a portion of the wellbore 114 being uncased. In an embodiment, a portion of wellbore 114 may remain uncemented, but may employ one or more packers (e.g., Swellpackers™, commercially available from Halliburton Energy Services, Inc.) to isolate two or more adjacent portions or zones within wellbore 114.

Referring to FIG. 1, a wellbore servicing system 100 is illustrated. In the embodiment of FIG. 1, wellbore servicing system 100 comprises a wellbore servicing tool 200 incorporated within work string 112 and positioned proximate and/or substantially adjacent to one of a plurality of subterranean formation zones (or "pay zones") 2, 4, 6, 8, 10 or 12. Additionally, although the embodiment of FIG. 1 illustrates wellbore servicing system 100 incorporated within work string 112, a similar wellbore servicing system may be similarly incorporated within any other suitable work string (e.g., a drill string, a tool string, a segmented tubing string, a jointed tubing string, a coiled-tubing string, or any other suitable conveyance, or combinations thereof), as may be appropriate for a given servicing operation. Additionally, while in the embodiment of FIG. 1, the wellbore servicing tool 200 is located and/or positioned substantially adjacent to a single zone (e.g., zone 12), a given single servicing tool 200 may be positioned adjacent to two or more zones.

Figure 2A:
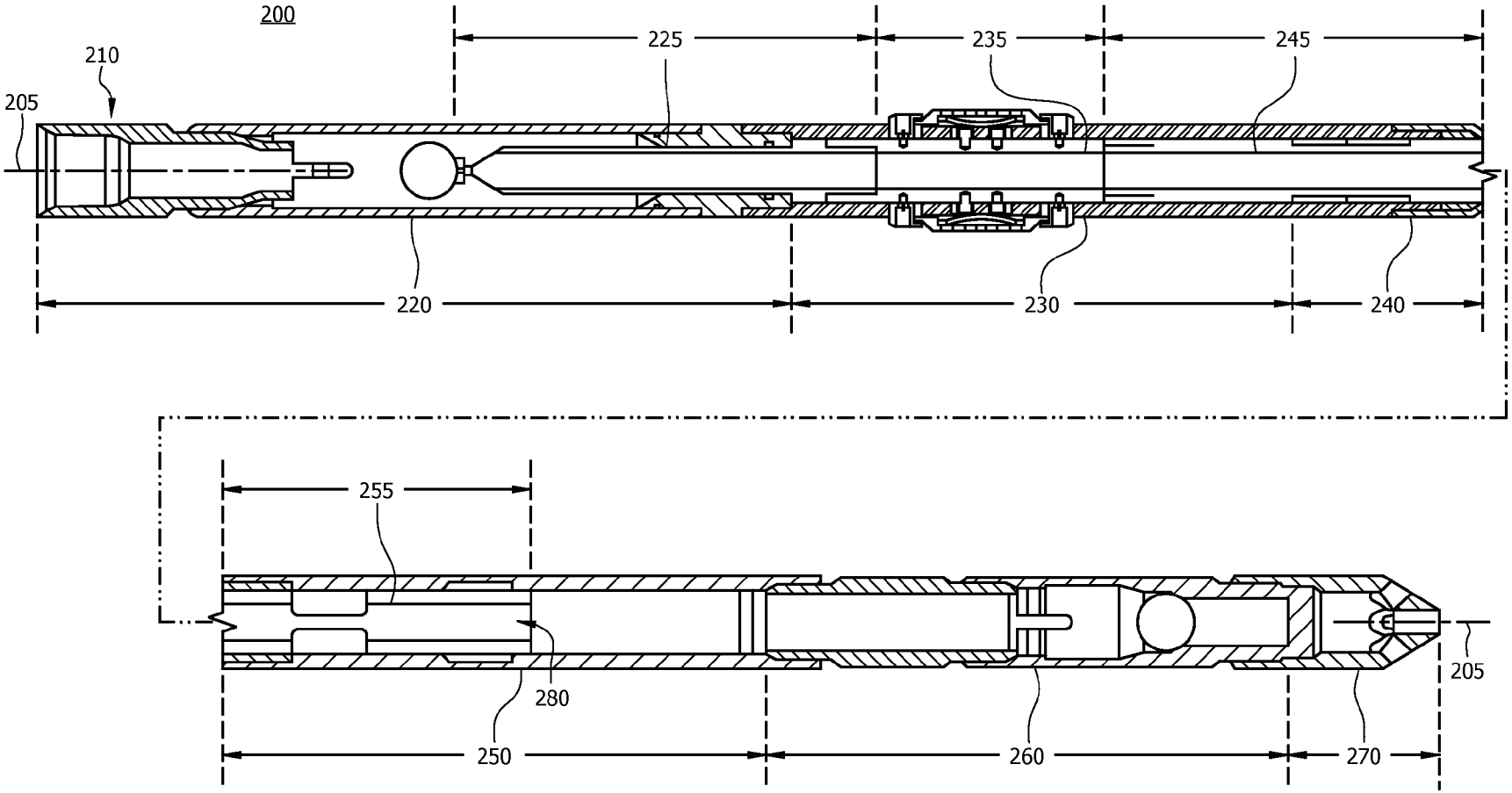
FIG. 2A is a cross-sectional view of an embodiment of a wellbore servicing tool.

Referring to the embodiment of FIG. 2A, wellbore servicing tool 200 generally comprises a housing 210 and a tubular member or mandrel 280. Also, the servicing tool 200 may be characterized with respect to a central or longitudinal axis 205.

In an embodiment, housing 210 may comprise a unitary structure (e.g., a single unit of manufacture, such as a continuous length of pipe or tubing); alternatively, housing 210 may comprise two or more operably connected components (e.g., two or more coupled sub-components, such as by a threaded connection). Alternatively, a housing like housing 210 may comprise any suitable structure; such suitable structures will be appreciated by those of skill in the art upon viewing this disclosure.

Referring to the embodiment of FIG. 2A, housing 210 comprises a plurality of operably connected sub-components (e.g., a plurality of coupled sub-components, such as by a threaded connection). Housing 210 generally comprises a first ball sub-component portion 220, a drag block assembly portion 230, an index pin housing portion 240, a mixing sub-component portion 250, a second ball sub-component portion 260, and a guiding device portion 270.

In an embodiment, mandrel 280 generally comprises a cylindrical or tubular structure disposed within housing 210. Mandrel 280 may be coaxially aligned with central axis 205 of housing 210. In an alternative embodiment, a mandrel like mandrel 280 may comprise two or more operably connected or coupled component pieces.

Referring to the embodiment of FIG. 2A, mandrel 280 comprises a plurality of operably connected sub-components (e.g., a plurality of coupled sub-components, such as by a threaded connection). Mandrel 280 comprises a first ball sub-component mandrel portion 225 that is generally associated with and disposed proximate (e.g., at least partially within) to the first ball sub-component portion 220 of housing 210. The first ball sub-component mandrel portion 225 is located at the upper terminal end of mandrel 280. Mandrel 280 further comprises a drag block assembly mandrel portion 235 that is generally associated with and disposed proximate (e.g., at least partially within) to the drag block assembly portion 230 of housing 210. The drag block assembly mandrel portion 235 is located at the upper middle section of mandrel 280. Mandrel 280 further comprises a J-slot mandrel portion 245 that is generally associated with and disposed proximate (e.g., at least partially within) to the index pin housing portion 240 of housing 210. The J-slot mandrel portion 245 is located at the lower middle section of mandrel 280. Mandrel 280 further comprises a mixing sub-component mandrel portion 255 that is generally associated with and disposed proximate (e.g., at least partially within) to the mixing sub-component portion 250 of housing 210. The mixing sub-component mandrel portion 255 is located at the lowest end part (i.e., lower terminal end part) of the mandrel 280.

In an embodiment, a wellbore servicing tool 200 is generally configured to be located/connected at the lower end of a work string 112. As will be apparent to those skilled in the art, the work string 112 may comprise other portions besides the wellbore servicing tool 200, such as for example a jetting subassembly 150, and the subcomponent parts of the servicing tool 200 may be re-arranged in any suitable configuration. Referring to the embodiment of FIG. 2A, a jetting subassembly may be coupled to the upper end of a wellbore servicing tool 200, i.e., to the upper end of the first ball sub-component portion 220 of housing 210.

In an embodiment, housing 210 comprises a first ball sub-component 220. Referring to the embodiment of FIG. 2B, the first ball sub-component 220 comprises a plurality of operably connected sub-components (e.g., a plurality of coupled sub-components, such as by a threaded connection). The first ball sub-component 220 generally comprises a stinger 221, a housing segment 222, a seat 223, and an obturating member (e.g., ball) 224.

In an embodiment, stinger 221 is located at the upper end of the first ball sub-component 220. Referring to the embodiments of FIGS. 2B and 3A, the stinger 221 generally comprises a cylindrical or tubular body 221*b* having a connecting surface (e.g., an internally or externally threaded surface) 221*a* located at the upper end of stinger 221. Such connecting surface 221*a* may be employed in making a connection to the work string 112 or any other suitable component, e.g., a jetting subassembly 150. The tubular body 221*b* generally defines a continuous flowpath 221*c* that allows fluid movement through stinger 221. The stinger 221 further comprises a stinger protrusion 221*d* located at the lower end of stinger 221. The stinger protrusion 221*d* may contact the obturating member (e.g., ball) 224 and prevent the obturating member 224 from entering and blocking flowpath 221*c*, when the obturating member 224 is adjacent to or in contact with stinger 221.

In an embodiment, housing segment 222 is located at the middle section of the first ball sub-component 220. Housing segment 222 comprises a cylindrical or tubular body that generally defines a flowpath 222*a*. In an embodiment, housing segment 222 may function to couple stinger 221 to seat 223, for example via threaded connections, and form a chamber or "cage" 222*b* to contain the obturating member 224. The obturating member (e.g., ball) 224 is free to move downward or upward within the chamber 222*b* responsive to fluid flow (e.g., downward/forward flow or upward/reverse flow) through the first ball sub-component 220.

In an embodiment, seat 223 is located at the lower end of the first ball sub-component 220. The seat 223 comprises a gradient surface (e.g., beveled surface) 223*a* located at the upper end of seat 223. Such gradient surface 223*a* may be a beveled surface or any other surface suitable for receiving and forming a sealing engagement with the obturating member 224. The seat 223 comprises an inner surface 223*b* that extends from the gradient surface 223*a* to the lowest end of the seat 223. Inner surface 223*b* defines a bore with a diameter that is smaller than the diameter of flowpath 222*a*. In an embodiment, the seat 223 may be integral with (e.g., joined as a single unitary structure and/or formed as a single piece) and/or connected to housing segment 222. For example, in an embodiment, seat 223 may be attached to housing segment 222. In an alternative embodiment, a seat may comprise an independent and/or separate component from the housing segment 222.

Figure 2B:
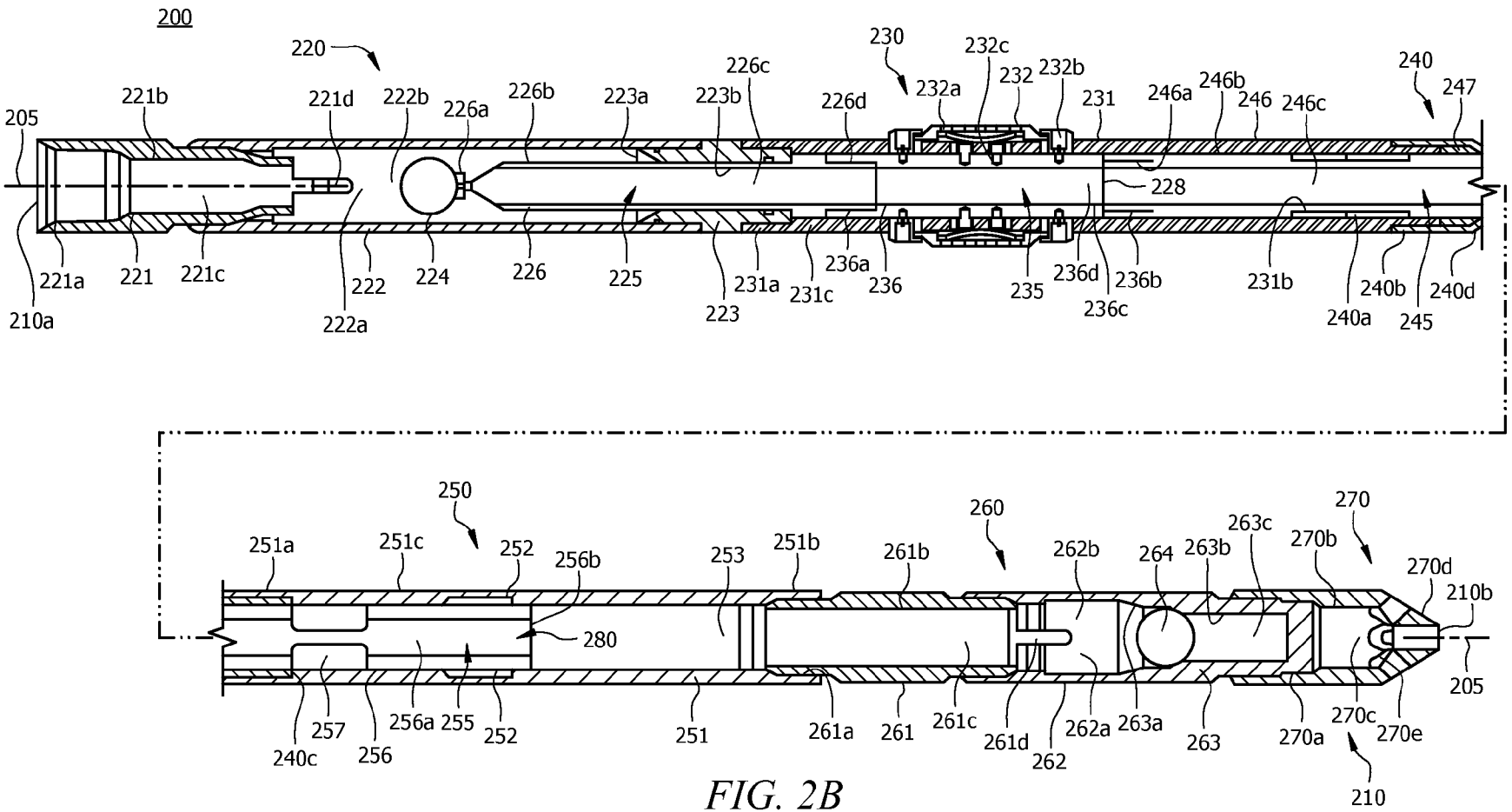
FIG. 2B is a cross-sectional view of an embodiment of the wellbore servicing tool of FIG. 2A in a "run-in-hole" configuration.
Figure 3A:
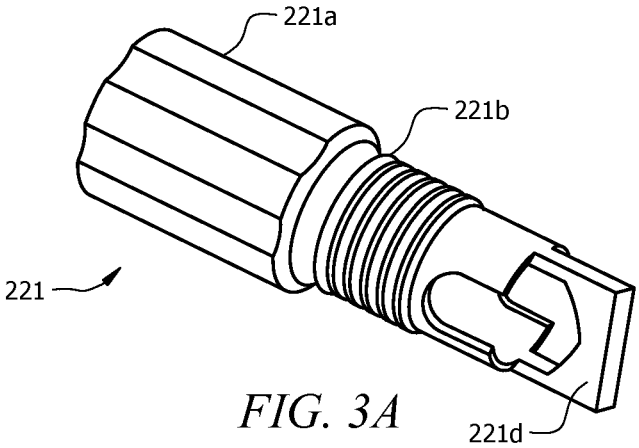
FIGS. 3A and 3B are isometric views of embodiments of stinger portions of a housing of the wellbore servicing tool of FIG. 2.

In an embodiment, obturating member 224 is located within flowpath 222*a*, for example in chamber 222*b*. Obturating member 224 may be a ball, dart, plug or other device configured to create a restriction of fluid flow along flowpath 222*a* when sealingly engaged with seat 223. Although FIG. 2B illustrates a ball-style check valve comprising a seat 223 and a ball 224, one of ordinary skill in the art will understand that the first ball sub-component 220 may comprise another suitable shape or configuration of check valves, for example, capable of allowing fluid movement in one axial direction while obstructing fluid communication in the opposite direction, e.g., a flapper valve.

In an embodiment, the first ball sub-component 220 contains/houses a portion of the mandrel 280 (e.g., a first ball sub-component mandrel portion 225) which will interact/interface with the ball 224, as will be described later herein.

In an embodiment, housing 210 comprises a drag block assembly portion 230. Referring to the embodiment of FIG. 2B, the drag block assembly portion 230 comprises a housing segment 231. The housing segment 231 comprises an upper connecting surface 231*a*, a lower connecting surface 231*b*, and a housing body 231*c*. The upper connecting surface 231*a* may couple to seat 223 of the first ball sub-component 220 via an upper connection, such as a threaded connection. The lower connecting surface 231*b* may couple to the index pin housing 240 via a lower connection, such as a threaded connection. Housing body 231*c* generally comprises a cylindrical or tubular body having a plurality of openings/slots that extend longitudinally/axially a distance between the upper connecting surface 231*a* and the lower connecting surface 231*b*. Such openings/slots may receive one or more drag block assembly (DBA) 232 and may allow the DBAs 232 to interact/interface with mandrel 280 and move longitudinally in the slots, as will be described later herein. The number and radial spacing of the slots corresponds to the number and radial spacing of the DBAs 232, as will be disclosed later herein.

In an embodiment, housing 210 comprises an index pin housing portion 240. Referring to the embodiment of FIG. 2B, the index pin housing portion 240 comprises a housing segment 240*b*. The housing segment 240*b* comprises an upper connecting surface 240*a*, a lower connecting surface 240*c*, and a housing body 240*d*. The upper connecting surface 240*a* may couple to the drag block assembly portion 230 via an upper connection, such as a threaded connection. The lower connecting surface 240*c* may couple to the mixing sub-component 250 via a lower connection, such as a threaded connection. Housing body 240*d* generally comprises a cylindrical or tubular body that that may further comprise one or more lugs 247 located on the inner surface of the housing body 240*d*.

In an embodiment, the housing body 240*d* comprises one or more lugs 247 configured to be received within a slot or indexing mechanism (e.g., J-slot mandrel portion 245) and to cooperatively control the rotational and/or axial displacement of mandrel 280, for example, via interaction with such a slot or indexing mechanism (e.g., J-slot mandrel portion 245). For example, the housing body 240*d* comprises one or more protrusions or lugs 247 which may extend radially inward from inner cylindrical surface of the housing body 240*d* and are configured (e.g., sized) to slidably fit within J-slot mandrel portion 245 of mandrel 280, as will be disclosed in more detail herein.

In an embodiment, housing 210 comprises a mixing sub-component 250. Referring to the embodiment of FIG. 2B, the mixing sub-component 250 comprises a housing segment 251. The housing segment 251 comprises an upper connecting surface 251*a*, a lower connecting surface 251*b*, and a housing body 251*c*. The upper connecting surface 251*a* may couple to the index pin housing portion 240 via an upper connection, such as a threaded connection. The lower connecting surface 251*b* may couple to the second ball sub-component 260 via a lower connection, such as a threaded connection. Housing body 251*c* comprises a cylindrical or tubular body that generally defines a flowpath 253. In an embodiment, housing body 251*c* comprises one or more openings 252 such as, for example, mixing ports, bores or relatively high-volume openings, e.g., relatively low-pressure (e.g., suitable for a fluid fracturing operation).

In an embodiment, the mixing sub-component 250 contains/houses a portion of the mandrel 280 (e.g., a mixing sub-component mandrel portion 255) which will interact/align with the openings 252, as will be described later herein.

In an embodiment, housing 210 comprises a second ball sub-component 260. Referring to the embodiment of FIG. 2B, the second ball sub-component 260 comprises a plurality of operably connected sub-components (e.g., a plurality of coupled sub-components, such as by a threaded connection). The second ball sub-component 260 generally comprises a stinger 261, a housing segment 262, a seat 263, and an obturating member (e.g., ball) 264.

Figure 3B:
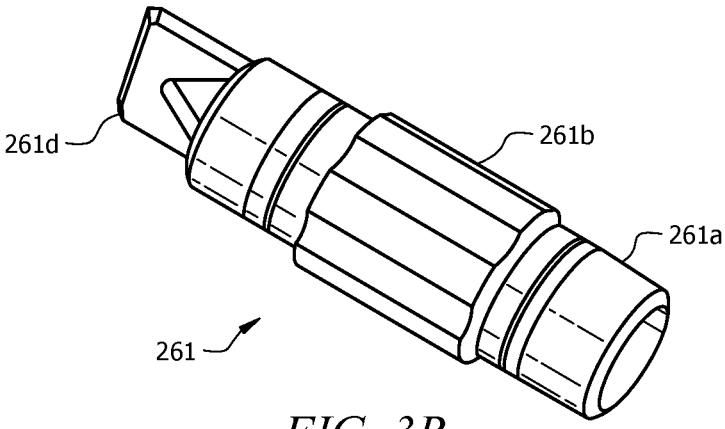

In an embodiment, stinger 261 is located at the upper end of the second ball sub-component 260. Referring to the embodiments of FIGS. 2B and 3B, the stinger 261 generally comprises a cylindrical or tubular body 261*b* having a connecting surface (e.g., an internally or externally threaded surface) 261*a* located at the upper end of stinger 261. Such connecting surface 261*a* may be employed in making a connection to the mixing sub-component 250. The tubular body 261*b* generally defines a continuous flowpath 261*c* that allows fluid movement through stinger 261. The stinger 261 further comprises a stinger protrusion 261*d* located at the lower end of stinger 261. The stinger protrusion 261*d* may contact the obturating member (e.g., ball) 264 and prevent the obturating member 264 from entering and blocking flowpath 261*c*, when the obturating member 264 is adjacent to or in contact with stinger 261.

In an embodiment, housing segment 262 is located at the middle section of the second ball sub-component 260. Housing segment 262 comprises a cylindrical or tubular body that generally defines a flowpath 262*a*. In an embodiment, housing segment 262 may function to couple stinger 261 to seat 263, for example via threaded connections, and form a chamber or "cage" 262*b* to contain the obturating member 264. The obturating member (e.g., ball) 264 is free to move downward or upward within the chamber 262*b* responsive to fluid flow (e.g., downward/forward flow or upward/reverse flow) through the second ball sub-component 260.

In an embodiment, seat 263 is located at the lower end of the second ball sub-component 260. The seat 263 comprises a gradient surface (e.g., beveled surface) 263*a* located at the upper end of seat 263. Such gradient surface 263*a* may be a beveled surface or any other surface suitable for receiving and forming a sealing engagement with the obturating member 264. The seat 263 comprises an inner surface 263*b* that extends from the gradient surface 263*a* to the lowest end of the seat 263. Inner surface 263*b* defines a flowpath 263*c* with a diameter that is smaller than the diameter of flowpath 262*a*. In an embodiment, the seat 263 may be integral with (e.g., joined as a single unitary structure and/or formed as a single piece) and/or connected to housing segment 262. For example, in an embodiment, seat 263 may be attached to housing segment 262. In an alternative embodiment, a seat may comprise an independent and/or separate component from the housing segment 262.

In an embodiment, obturating member 264 is located within flowpath 262*a*, for example in chamber 262*b*. Obturating member 264 may be a ball, dart, plug or other device configured to create a restriction of fluid flow along flowpath 262*a* when sealingly engaged with seat 263. Although FIG. 2B illustrates a ball-style check valve comprising a seat 263 and a ball 264, one of ordinary skill in the art will understand that the second ball sub-component 260 may comprise another suitable shape or configuration of check valves, for example, capable of allowing fluid movement in one axial direction while obstructing fluid communication in the opposite direction, e.g., a flapper valve.

In an embodiment, housing 210 comprises a guiding device portion 270, also referred to as a guide shoe, which may be located at a terminal end of wellbore servicing tool 200 to aid in the placement of the tool within the wellbore. The guiding device 270 generally comprises a cylindrical or tubular body 270*b* having a connecting surface (e.g., an internally or externally threaded surface) 270*a* located at the upper end of guiding device 270. Such connecting surface 270*a* may be employed in making a connection to the seat 263. The tubular body 270*b* generally defines a flowpath 270*c* that allows fluid movement through the guiding device 270. The tubular body 270*b* comprises one or more ports 270*e* providing a route a fluid communication between the flowpath 270*c* and the exterior of the housing 210. The guiding device 270 further comprises a guiding face 270*d* located at the lower end of guiding device 270. In an embodiment, the guiding face 270*d* may have a conical shape or any other suitable shape that aids in the insertion, traversal and placement of the wellbore servicing tool 200 in the wellbore.

Figure 5A:
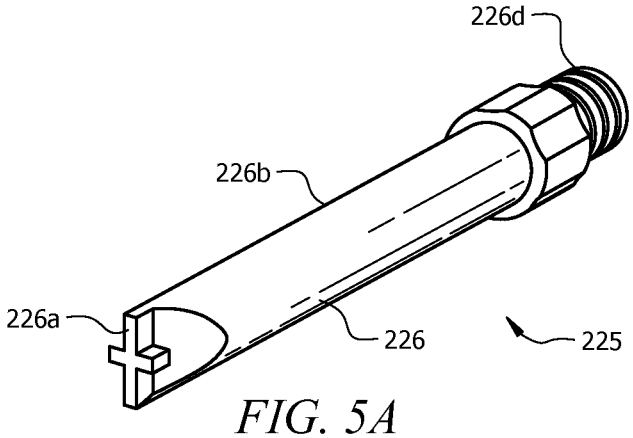
FIG. 5A is an isometric view of an embodiment of a stinger portion of a mandrel of the wellbore servicing tool of FIG. 2.
Figure 5B:
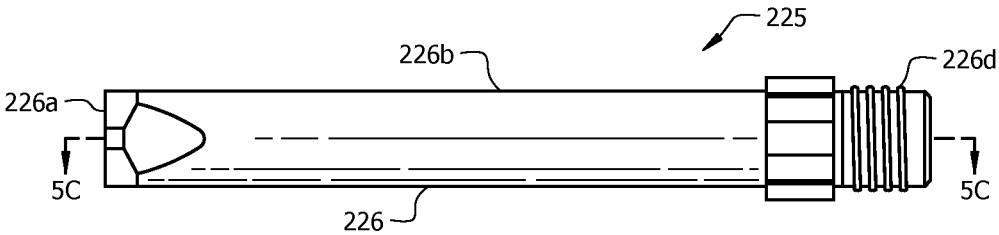
FIG. 5B is a side view of the stinger of FIG. 5A.
Figure 5C:
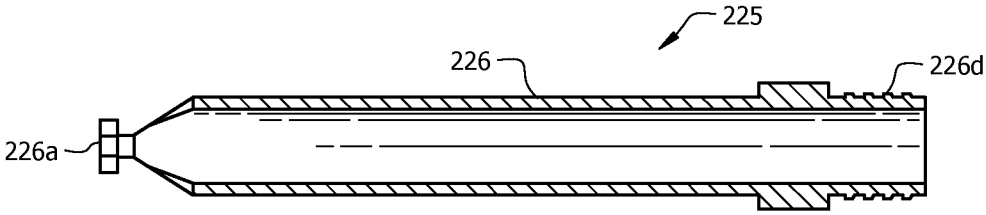
FIG. 5C is a cross-sectional view along line C-C of the stinger of FIG. 5B.

In an embodiment, mandrel 280 comprises a first ball sub-component mandrel portion 225. Referring to the embodiments of FIGS. 2B and 5, the first ball sub-component mandrel portion 225 comprises a stinger 226. The stinger 226 generally comprises a cylindrical or tubular body 226*b* having a connecting surface (e.g., an internally or externally threaded surface) 226*d* located at the lower end of stinger 226. Such connecting surface 226*d* may be employed in making a connection to the drag block assembly mandrel portion 235. The tubular body 226*b* generally defines a continuous flowpath 226*c* that allows fluid movement through stinger 226. The stinger 226 further comprises a stinger protrusion 226*a* located at the upper end of stinger 226. Dependent upon the configuration of the tool 200, as will be disclosed herein, stinger protrusion 226*a* may contact the obturating member (e.g., ball) 224 and prevent the obturating member 224 from seating within and blocking flowpath 226*c*, when the obturating member 224 is adjacent to or in contact with stinger 226.

In an embodiment, at least a portion of the first ball sub-component mandrel portion 225 of mandrel 280 may be slidably fitted against a portion of the inner cylindrical surface of seat 223, as shown in FIG. 2B. The first ball sub-component mandrel portion 225 may move longitudinally within housing 210, by sliding through seat 223, thereby preventing ball 224 from engaging seat 223, depending upon the position of the stinger 226 of the first ball sub-component mandrel 225 relative to housing 210, as will be described later herein.

In an embodiment, mandrel 280 comprises a drag block assembly mandrel portion 235. Referring to the embodiment of FIG. 2B, the drag block assembly mandrel portion 235 comprises a mandrel segment 236. The mandrel segment 236 comprises an upper connecting surface 236*a*, a lower connecting surface 236*b*, and a mandrel body 236*c*. The upper connecting surface 236*a* may couple to the stinger 226 via an upper connection, such as a threaded connection. The lower connecting surface 236*b* may couple to the J-slot mandrel portion 245 via a lower connection, such as a rotatable connection 228 comprising bearings or bushings. The rotatable connection 228 allows rotation of the J-slot in response to non-rotational (e.g., axial/longitudinal) movement of the drag block assembly mandrel portion 235 Mandrel body 236*c* comprises a cylindrical or tubular body that generally defines a flowpath 236*d*. In an embodiment, mandrel body 236*c* contacts and/or is attached to a plurality of DBAs 232.

Figure 6:
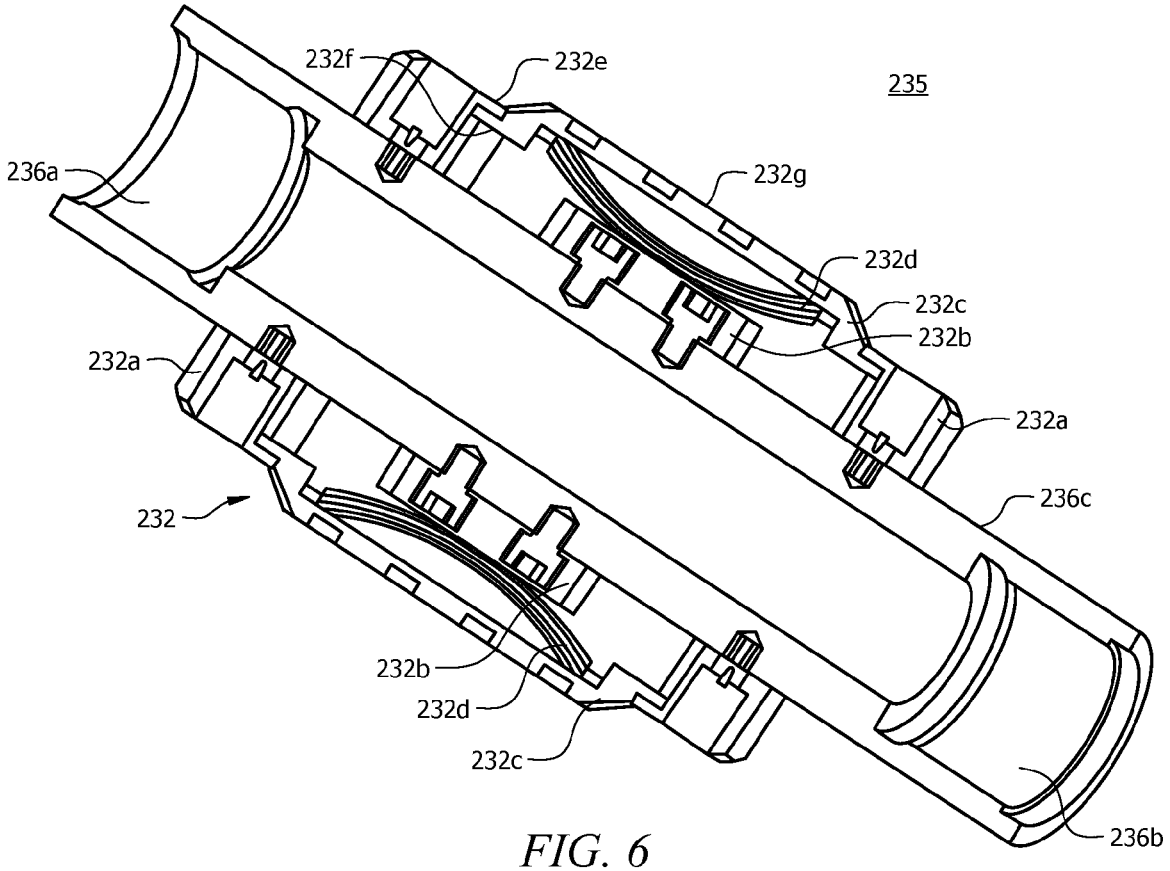
FIG. 6 is a cross-sectional view of a drag block assembly of the wellbore servicing tool of FIG. 2.

In an embodiment, the DBAs 232 may be configured to exert a radially outward force onto the casing 120, and also to translate a longitudinal force between the casing 120 and the drag block assembly mandrel portion 235 of mandrel 280, as will be disclosed herein. Referring to the embodiments of FIGS. 2B and 6, each of the DBAs 232 may comprise a plurality of structural features, such as one or more fixed outer base parts 232*a*, one or more fixed inner base parts 232*b*, a movable element 232*c*, and one or more compressible elements 232*d*. In an embodiment, the movable element 232*c* may be radially movable (e.g., radially outward) with respect to the longitudinal axis 205 by a compressible element 232*d* which rests on the fixed inner base part 232*b*. The movable element 232*c* comprises an external surface 232*g* that may further comprise a coating, texture and/or surface configuration for the purpose of increasing friction between the movable element 232*c* and the casing 120. In an embodiment, the fixed outer base parts 232*a* and the fixed inner base parts 232*b* may be used for attaching the DBA 232 to the mandrel body 236*c*, e.g., by using screws. The fixed outer base part 232*a* comprises a ridge or spine having an inner shoulder 232*e*, and the movable part 232*c* comprises a groove or slot having an outer shoulder 232*f*. In an embodiment, the movable element 232*c* is configured so as to receive the ridge/spine within the groove/slot and be movable in a spatially defined relationship with respect to the mandrel body 236*c*. For example, the outer shoulder 232*f* may not travel radially outward (i.e., away from longitudinal axis 205) past inner shoulder 232*e* of the ridge/spine of outer base part 232*a*. The compressible element 232*d*, for example a spring such as a wave spring or a plurality of coiled springs, is located between the fixed part 232*b* and the movable part 232*c*, thereby mediating or biasing (e.g., radially outward) the movement of the movable part 232*c*, as will be described in more detail later herein.

In an embodiment, mandrel body 236*c* comprises 4 DBAs that are located at about 90° with respect to each other. In such embodiment, the drag block assembly portion 230 comprises 4 longitudinal slots which are located about equidistant from each other across the circumference of the drag block assembly portion 230. Alternatively, in an embodiment, mandrel body 236*c* contacts 3 DBAs that are located at about 120° with respect to each other. In such embodiment, the drag block assembly portion 230 comprises 3 longitudinal slots which are located about equidistant from each other across the circumference of the drag block assembly portion 230. Other numbers of DBAs may be used in different configurations, as will be apparent to those skilled in the art. The longitudinal slots of the drag block assembly portion 230 receive the corresponding number of DBAs, and the DBAs may move longitudinally in such slots, as will be described in more detail herein.

In an embodiment, mandrel 280 comprises a J-slot mandrel portion 245. In an embodiment, the J-slot mandrel portion 245 may comprise a continuous slot 248, i.e., a continuous J-slot, a control groove, an indexing slot, or combinations thereof. As used herein, the continuous slot 248 may be a slot, such as a groove or depression having a depth beneath the outer surface of the J-slot mandrel portion 245 and extending entirely about (i.e., 360 degrees) the circumference of the J-slot mandrel portion 245, though not necessarily in a single straight path.

Figure 4A:
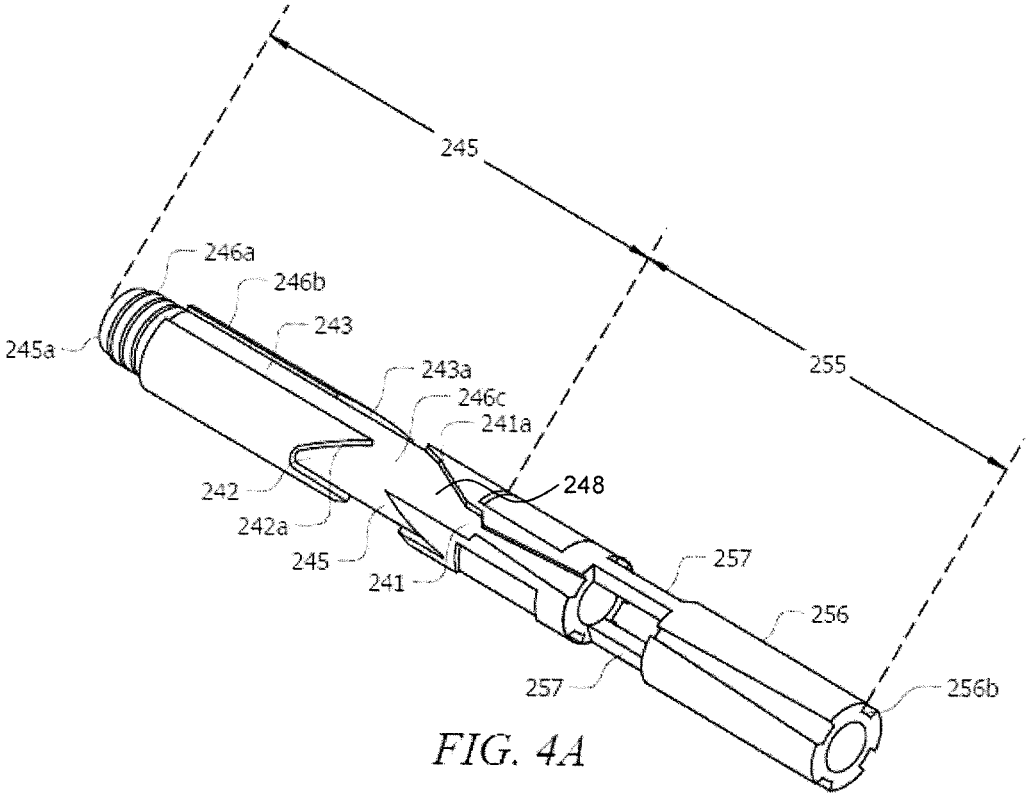
FIG. 4A is an isometric view of an embodiment of a J-slot and mixing sub-component portions of a mandrel of the wellbore servicing tool of FIG. 2.
Figure 4B:
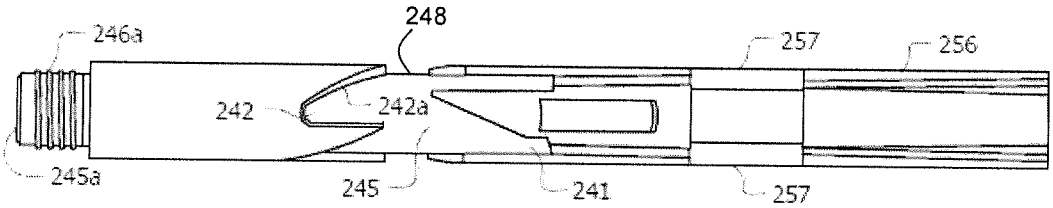
FIGS. 4B and 4C are side views of the J-slot and mixing sub-component portions of FIG. 4A.
Figure 4C:
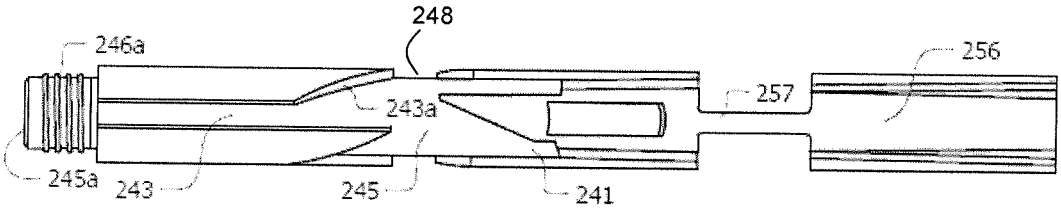

Referring to the embodiments of FIGS. 2B and 4, the J-slot mandrel portion 245 generally comprises a cylindrical or tubular body 246*b* having an upper connecting surface 246*a*. In an embodiment, the upper connecting surface 246*a* may be employed in making a rotatable connection comprising bearings, bushings, circumferential rims, lips, shoulders, or the like, to the drag block assembly mandrel portion 235. The tubular body 246*b* generally defines an inner external surface 246*c*, which functions as a flowpath that allows fluid movement through the J-slot mandrel portion 245.

The continuous slot 248 of the J-slot mandrel portion 245 generally comprises one or more short lower notches 241 (e.g., extending axially downward toward the lower terminal end 256*b* of mandrel 280), one or more first or short upper notches 242 (e.g., extending axially upward toward the upper terminal end 245*a* of J-slot mandrel portion 245), and one or more second or long upper notches 243 (e.g., extending axially upward toward the upper terminal end 245*a* of J-slot mandrel portion 245). Long upper notches 243 extend farther axially in the direction of the upper terminal end 245*a* than short upper notches 242. Moving radially around the circumference of inner external surface 246*c* of J-slot mandrel portion 245, each long upper notch 243 is followed by a short upper notch 242, for example, thereby forming an alternating pattern of long upper notches 243 and short upper notches 242 (e.g., long upper notch 243-short upper notch 242-long upper notch 243-short upper notch 242, etc.). One or more lower sloped edges 241*a* extend between short lower notches 241, partially defining each short lower notch 241. One or more upper sloped edges 242*a* and/or 243*a* extend between each long upper notch 243 and short upper notch 242, partially defining the upper notches (e.g., short upper notch 242 and long upper notch 243).

In the embodiments of FIGS. 2B and 4, the continuous slot 248 of the i-slot mandrel portion 245 is configured to receive one or more protrusions or lugs 247 coupled to and/or integrated within a component (e.g., housing 210), so as to guide the axial and/or rotational movement of mandrel 280, as will be described later herein.

Referring to the embodiment of FIG. 2B, the J-slot mandrel portion 245 of mandrel 280 may be slidably and concentrically positioned within housing 210. At least a portion of the J-slot mandrel portion 245 of mandrel 280 may be slidably fitted against a portion of inner cylindrical surface of index pin housing 240 to interact with lugs 247, as shown in FIG. 2B.

In an alternative embodiment, the J-slot may be part of the housing 210, and the mandrel 280 may comprise the lugs designed to guide the axial and/or rotational movement of mandrel 280. One of ordinary skill in the art, with the help of this disclosure, would appreciate various additional and/or alternative configurations of a J-slot, a lug, and/or their interaction thereof.

In an embodiment, mandrel 280 comprises a mixing sub-component mandrel portion 255. Referring to the embodiments of FIGS. 2B and 4, the mixing sub-component mandrel portion 255 comprises a mandrel segment 256. Mandrel segment 256 comprises a cylindrical or tubular body that generally defines a flowpath 256*a*. The mandrel segment 256 further comprises one or more mixing ports, bores or relatively high-volume openings 257 (e.g., suitable for a fluid fracturing operation). The mandrel segment 256 of mandrel 280 comprises a lower end 256*b* that is open ended to allow for the free flow of fluid. In an embodiment, the mandrel segment 256 may be integral with (e.g., joined as a single unitary structure and/or formed as a single piece) and/or connected to the J-slot mandrel portion 245. For example, in an embodiment, mandrel segment 256 may be attached to the J-slot mandrel portion 245. In an alternative embodiment, a mandrel segment such as mandrel segment 256 may comprise an independent and/or separate component from the J-slot mandrel portion 245.

In an embodiment, mandrel segment 256 comprises 2 openings 257 that are located at 180° with respect to each other. In such embodiment, the mixing sub-component 250 comprises 2 openings 252 that are located at 180° with respect to each other. Other numbers and configurations for the relatively high-volume openings may be used, as will be apparent to those skilled in the art.

In an embodiment, the openings 257 of the mixing sub-component mandrel portion 255 will selectively interact/align with the openings 252 of the mixing sub-component 250, to selectively allow for high volumes of fluid to be communicated to the outside part of housing 210, as will be described in more detail herein.

In an embodiment, as noted herein, the wellbore servicing tool 200 may be part of or connected to a work string 112. In an embodiment, wellbore servicing tool 200 may be combined with a jetting subassembly 150, for example positioned below a jetting subassembly 150 as shown in FIG. 1. For example, a jetting subassembly 150 comprises a housing having one or more relatively high-pressure ports, e.g., relatively low-volume, 130 (e.g., suitable for a perforating or fluid jetting operation) that may be configured to communicate a fluid from the axial flowbore 126 of work string 112 to a proximate subterranean formation zone. In an embodiment, the high-pressure ports 130 may be fitted with one or more pressure-altering devices (e.g., nozzles, erodible nozzles, jets, or the like). In an additional embodiment, the high-pressure ports 130 may be fitted with plugs, screens, covers, or shields, for example, to selectively open and close the ports, and/or to prevent debris from entering the high-pressure ports 130. As will be described herein, where forward fluid flow (e.g., pumping of fluid downhole) is blocked through wellbore servicing tool 200, fluid flow may be diverted through the ports 130 of jetting subassembly 150.

Having described the work string 112 and the wellbore servicing tool 200, the disclosure will now further describe the operation of the wellbore servicing tool 200 and the configurations thereof employed during use in a wellbore servicing operation, for example a wellbore fracturing operation.

Figure 2C:
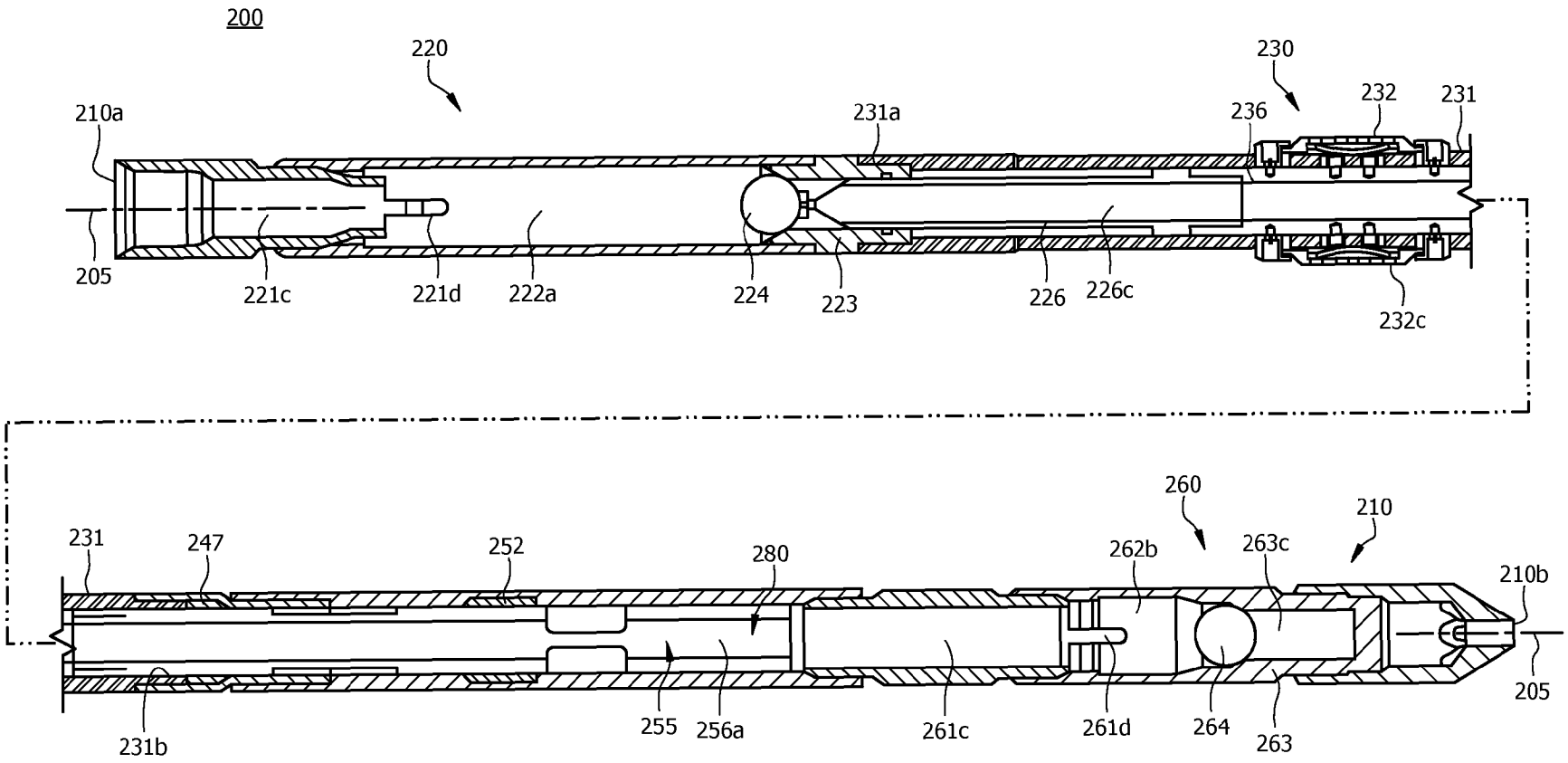
FIG. 2C is a cross-sectional view of an embodiment of the wellbore servicing tool of FIG. 2A in a "perforating" or "jetting" configuration.
Figure 2D:
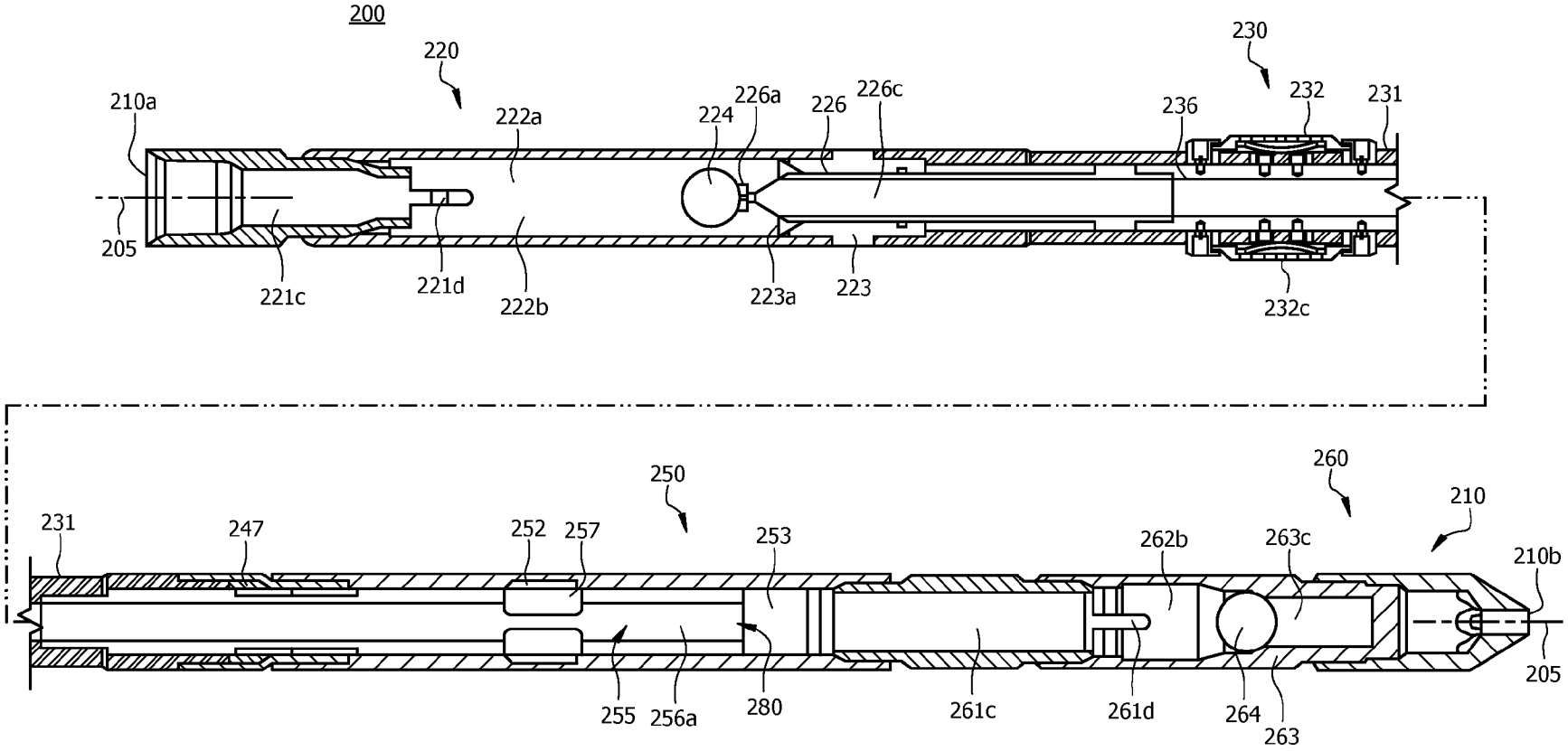
FIG. 2D is a cross-sectional view of an embodiment of the wellbore servicing tool of FIG. 2A in a "fracturing" or "mixing" configuration.

Reference is now made to FIGS. 2B, 2C and 2D wherein the wellbore servicing tool 200 is shown in three different configurations. FIG. 2B shows the wellbore servicing tool 200 in a "first" configuration, also referred to herein as a "run-in-hole" (RIH) or "indexing" configuration. FIG. 2C shows the wellbore servicing tool 200 in a "second" configuration, also referred to herein as a "jetting" or "perforating" configuration. FIG. 2D shows the wellbore servicing tool 200 in a "third" configuration, also referred to herein as a "mixing" or "fracturing" configuration. Unless otherwise noted, the parts of the wellbore servicing tool 200 from FIGS. 2A, 2B, 2C and 2D are the same and referred to with common numerals and the left side of each figure represents an upper or up-hole portion of the tool (e.g., upper end of housing 210*a*) and the right side of each figure represents a lower or down-hole portion of the tool (e.g., lower end of housing 210*b*) when positioned within a wellbore.

In one or more of the embodiments disclosed herein, wellbore servicing tool 200 may be configured to be actuated while disposed within a wellbore such as wellbore 114. In an embodiment, servicing tool 200 may be configured to alternatingly cycle between transitioning from the first configuration to the second configuration and transitioning from the first configuration to the third configuration. For example, in an embodiment such a wellbore servicing apparatus may be transitioned from the first configuration to the second configuration, from the second configuration back to the first configuration and, then, from the first configuration to the third configuration, as will be disclosed herein. Additionally, in an embodiment, such a wellbore servicing apparatus may be transitioned from the third configuration back to the first configuration and, then, the cycle repeated again, as will also be disclosed herein.

Referring to FIG. 2B, an embodiment of a wellbore servicing tool 200 is illustrated in the first (RIH) configuration. When the wellbore servicing tool 200 is placed downhole ("run-in-hole") during a wellbore servicing operation, the tool 200 may be in the first configuration. Mandrel 280 is disposed in a first position within the housing 210, i.e., mandrel 280 is in its uppermost position with respect to the housing 210. In the first configuration of the wellbore servicing tool 200, (e.g., where mandrel 280 is in the first position within housing 210) lugs 247 are disposed within the short lower notches 241, which also corresponds to the DBAs 232 being in the uppermost position within the slots of the drag block assembly portion 230, i.e., the position within the slots closest to the upper connecting surface 231*a* of housing segment 231. The movable element 232*c* of the DBA 232 will exert a radially outward force against the casing 120 and/or a wellbore wall.

In the embodiment of FIG. 2B, where the mandrel 280 is in the first position, fluid may freely travel through the first ball sub-component 220, as the ball 224 is located in chamber 222*b* and does not impede flow there through. Specifically, the position of stinger 226 prevents the ball 224 from engaging seat 223, thereby allowing the flow of fluid via flowpath 226*c*. Ball 264 is housed within chamber 262*b* of the second ball sub-component 260, as previously described herein. When ball 264 is engaged in seat 263 (e.g., during forward circulation of fluid into the wellbore), ball 264 restricts the flow of fluid to flowpath 263*c*. The second ball sub-component 260 may also allow for a recirculation mode (e.g., reverse fluid flow out of the wellbore) for the wellbore servicing tool 200, where the ball 264 is not engaged in seat 263, and fluid may flow upward via flowpath 263*c*, as is described herein. Likewise, in some embodiments, fluid may be allowed flow upward through the tool, for example during run-in of the tool, as is described herein. Also, when mandrel 280 is in the first position, the mixing sub-component mandrel portion 255 covers openings 252, thereby obstructing a route of fluid communication via the openings 252.

In an embodiment, when the wellbore servicing tool 200 is in the first configuration, the wellbore servicing tool 200 may be transitionable to the second configuration, as will be disclosed herein. In an embodiment, mandrel 280 is movable (i.e., may be transitioned) along the longitudinal axis 205 from the first position into a second position.

Referring to FIG. 2C, an embodiment of a wellbore servicing tool 200 is illustrated in the second (jetting) configuration, wherein mandrel 280 is disposed in a second position within the housing 210, i.e., mandrel 280 is in its lowermost position with respect to the housing 210. In the second configuration of the wellbore servicing tool 200, (e.g., where mandrel 280 is in the second position within housing 210) lugs 247 are disposed within the long upper notches 243, which also corresponds to the DBAs 232 being in the lowermost position within the slots of the drag block assembly portion 230, i.e., the position within the slots closest to the lower connecting surface 231*b* of housing segment 231. The movable element 232*c* of the DBA 232 will rest against the casing 120 and/or a wellbore wall.

In the embodiment of FIG. 2C, where the mandrel 280 is in the second position, a flow path between the upper end of housing 210*a* and the lower end of housing 210*b* may be obstructed by the first ball sub-component 220. When the mandrel 280 is in the second position, the ball 224 may sealingly engage in seat 223 of the first ball sub-component 220, e.g., during forward circulation of fluid into the wellbore. Upon engaging the seat 223, ball 224 may substantially restrict or impede the passage of fluid from one side of the ball to the other, i.e., may prevent the downward flow of fluid via flowpath 226*c*. In the second configuration, the flow of fluid (e.g., perforating fluid) into the workstring 112 may be directed towards the high-pressure ports of the jetting subassembly 150, as is described herein. The first ball sub-component 220 and the second ball sub-component 260 may also allow for a recirculation mode (e.g., reverse fluid flow out of the wellbore) for the wellbore servicing tool 200, where the ball 224 and the ball 264 are not engaged in their seats (i.e., seat 223 and seat 263, respectively), and fluid may flow upward via flowpaths 263*c* and 226*c*, as is described herein. Also, in an embodiment, when mandrel 280 is in the second position, the mixing sub-component mandrel portion 255 covers openings 252, thereby obstructing a route of fluid communication via the openings 252.

In an embodiment, when the wellbore servicing tool 200 is in the second configuration, the wellbore servicing tool 200 may be transitionable back to the first configuration, as will be disclosed herein. In an embodiment, mandrel 280 is movable (i.e., may be transitioned) along the longitudinal axis 205 from the second position back into the first position.

In an embodiment, when the wellbore servicing tool 200 is in the first configuration, the wellbore servicing tool 200 may also be transitionable to the third configuration, as will be disclosed herein. In an embodiment, mandrel 280 is movable (i.e., may be transitioned) along the longitudinal axis 205 from the first position into the third position.

Referring to FIG. 2D, an embodiment of a wellbore servicing tool 200 is illustrated in the third (mixing) configuration, wherein mandrel 280 is disposed in a third position within the housing 210. The third position of mandrel 280 is intermediate between the first position and the second position, i.e., mandrel 280 is in a lower position with respect to the first position, and in an upper position with respect to the second position, with respect to housing 210. In the third configuration of the wellbore servicing tool 200, (e.g., where mandrel 280 is in the third position within housing 210) lugs 247 are disposed within the short upper notches 242. The DBAs 232 will be located in an intermediate position within the slots of the drag block assembly portion 230, when compared to the position of the DBAs 232 within the slots of the drag block assembly portion 230 in the first and second configurations. The movable element 232*c* of the DBA 232 will rest against the casing 120 and/or a wellbore wall.

In the embodiment of FIG. 2D, where the mandrel 280 is in the third position, fluid may freely travel through the first ball sub-component 220, as the ball 224 is located in chamber 222*b* and does not impede flow there through. Specifically, the position of stinger 226 (e.g., with the stinger protrusion 226*a* located within chamber 222*b*) prevents the ball 224 from engaging seat 223, thereby allowing the flow of fluid via flowpath 226*c*. Ball 264 is housed within chamber 262*b* of the second ball sub-component 260, as previously described herein. When ball 264 is engaged in seat 263 (e.g., during forward circulation of fluid into the wellbore), ball 264 restricts the flow of fluid to flowpath 263*c*, thereby directing flow to openings 257/252. The second ball sub-component 260 may also allow for a recirculation mode (e.g., reverse fluid flow out of the wellbore) for the wellbore servicing tool 200, where the ball 264 is not engaged in seat 263, and fluid may flow upward via flowpath 263*c*, as is described herein.

In the third configuration, the flow of fluid (e.g., fracturing fluid) may be directed towards openings 257 that are aligned with openings 252, as is described herein. When mandrel 280 is in the third position, openings 257 of the mixing sub-component mandrel portion 255 are aligned with the openings 252 of the mixing sub-component 250, thereby allowing a route of fluid communication between flowpath 222*a* and the exterior of housing 210.

In an embodiment, when the wellbore servicing tool 200 is in the third configuration, the wellbore servicing tool 200 may be transitionable back to the first configuration, as will be disclosed herein. In an embodiment, mandrel 280 is movable (i.e., may be transitioned) along the longitudinal axis 205 from the third position back into the first position.

In some embodiments of the wellbore servicing tool 200, each of the first configuration, the second configuration, and the third configuration may be used in a recirculation mode. In an embodiment, when the servicing tool 200 is in the recirculation mode of either of the three configurations, servicing tool 200 is configured to provide a route of fluid communication, particularly, an upward route of fluid communication, from an exterior of the tool 200, through an axial flowbore (e.g., flowpaths 263*c*, 261*c*, 256*a*, 226*c*, 222*a*, etc.) of servicing tool 200, to the flowbore 126 of work string 112.

In an embodiment, when the wellbore servicing tool 200 is in the recirculation mode of either of the three configurations, each of the tool configurations is as previously described herein, except for the position of the balls 224 and 264. Ball 224 will be in contact with/adjacent to stinger protrusion 221*d*, thereby allowing a route of fluid communication between flowpaths 226*c*, 222*a* and 221*c*. Ball 264 will be in contact with/adjacent to stinger protrusion 261*d*, thereby allowing a route of fluid communication between flowpaths 263*c*, 261*c* and 256*a*.

In an embodiment, the servicing tool 200 may be transitioned into the recirculation mode of either of the three configurations, as will be disclosed herein.

In an embodiment, the DBAs 232 are in contact with/attached to the mandrel 280 and may engage casing 120 and/or a wellbore wall by frictional contact upon movement of the wellbore servicing tool 200 within the wellbore. Upon movement (e.g., longitudinal, upward and/or downward movement) of wellbore servicing tool 200 within casing 120/wellbore, frictional contact between the DBAs 232 and the casing 120 and/or a wellbore wall may impart a force upon the mandrel 280 and cause movement (e.g., displacement) of the mandrel 280 (e.g., drag block assembly mandrel portion 23) relative to the housing 210. Longitudinal/axial movement of the drag block assembly mandrel portion 230 (which is guided and restricted by movement within the slots of drag block assembly portion 230) may impart longitudinal and/or rotational movement of the J-slot mandrel portion 245 via rotatable connection 228 such that the J-slot my rotate about the lugs 247 as described herein during reconfiguration (e.g., cycling) of the tool.

During movement of the work string 112 and or tool 200 resulting in frictional contact with a surface of the casing and/or wellbore wall (referred to herein as frictional movement), the movable element 232*c* of the DBA 232 exerts a force against the casing 120/wellbore, and as such the axial longitudinal movement of the DBAs 232 (and of the mandrel 280 connected thereto) is impeded relative to the housing by a frictional force that arises between the movable element 232*c* and the casing 120/wellbore resulting in displacement of the mandrel 280 relative to the housing 210. Accordingly, the frictional movement of the wellbore servicing tool 200 impedes the movement of the mandrel 280 with respect to the housing 210, i.e., the housing 210 may exhibit more axial longitudinal movement than the mandrel 280 and the DBAs 232 which are in contact with/attached to the mandrel 280. Engagement of the DBAs 232 with the casing 120/wellbore may be aided for example by the design of the drag blocks (e.g., the spring force with which moveable elements 232*c* are forced radially outward toward surface engagement, the size/location/position/texture/material of the contact surface of moveable elements 232*c*, etc.). In an embodiment, the DBAs may engage the casing 120/wellbore as triggered by an inertia-activated component (e.g., switch, catch, damper, centrifugal clutch, weighted pendulum, motion sensor, or the like) such that a predetermined movement of the wellbore servicing tool (e.g., acceleration, deceleration, and/or force of movement) may activate the inertia-activated component that aids in the engagement (e.g., biting or setting) of the DBAs with the casing 120/wellbore. Movement of the wellbore servicing tool 200 may be continuous and/or intermittent and may occur over a distance (e.g., the DBAs may skip, chatter, slip, stop/go, set/release, or otherwise move somewhat over a distance within the wellbore as movement is imparted to the mandrel 280), and likewise the force upon and/or displacement of the mandrel may be continuous and/or intermittent and may occur over a corresponding distance within the wellbore.

In an embodiment, to transition the wellbore servicing tool 200 from the first configuration of servicing tool 200 (e.g., RIH configuration, illustrated in FIG. 2B) to the second configuration (e.g., jetting configuration, illustrated in FIG. 2C) the work string 112 comprising the wellbore servicing tool 200 may be moved (i.e., via frictional movement, as previously described herein) upwardly with respect to the casing 120 a distance enough to effect the transition of the mandrel 280 from the first position relative to the housing 210 into the second position relative to the housing 210. The housing 210 of wellbore servicing tool 200 will move in the axially upward direction (e.g., running out direction) with respect to the casing 120, and may cause the tool 200 to arrive in the second configuration.

In an embodiment, to transition the wellbore servicing tool 200 from the second configuration of servicing tool 200 (e.g., jetting configuration, illustrated in FIG. 2C) back to the first configuration (e.g., RIH configuration, illustrated in FIG. 2B) the work string 112 comprising the wellbore servicing tool 200 may be moved (i.e., via frictional movement, as previously described herein) downwardly with respect to the casing 120 a distance enough to effect the transition of the mandrel 280 from the second position relative to the housing 210 back into the first position relative to the housing 210. The housing 210 of wellbore servicing tool 200 will move in the axially downward direction (e.g., running in direction) with respect to the casing 120, and may cause the tool 200 to arrive back in the first configuration.

In an embodiment, to transition the wellbore servicing tool 200 from the first configuration of servicing tool 200 (e.g., RIH configuration, illustrated in FIG. 2B) to the third configuration (e.g., mixing configuration, illustrated in FIG. 2D) the work string 112 comprising the wellbore servicing tool 200 may be moved (i.e., via frictional movement, as previously described herein) upwardly with respect to the casing 120 a distance enough to effect the transition of the mandrel 280 from the first position relative to the housing 210 into the third position relative to the housing 210. The housing 210 of wellbore servicing tool 200 will move in the axially upward direction (e.g., running out direction) with respect to the casing 120, and may cause the tool 200 to arrive in the third configuration.

In an embodiment, to transition the wellbore servicing tool 200 from the third configuration of servicing tool 200 (e.g., mixing configuration, illustrated in FIG. 2D) back to the first configuration (e.g., RIH configuration, illustrated in FIG. 2B) the work string 112 comprising the wellbore servicing tool 200 may be moved (i.e., via frictional movement, as previously described herein) downwardly with respect to the casing 120 a distance enough to effect the transition of the mandrel 280 from the third position relative to the housing 210 back into the first position relative to the housing 210. The housing 210 of wellbore servicing tool 200 will move in the axially downward direction (e.g., running in direction) with respect to the casing 120, and may cause the tool 200 to arrive back in the first configuration.

Further, in an embodiment, the wellbore servicing tool 200 may be configured to cycle between the second and third configurations via the first configuration. Specifically, servicing tool 200 may be configured to transition, as disclosed herein, from the first configuration to the second configuration (e.g., by moving housing 210 upwardly), from the second configuration back to the first configuration (e.g., by moving housing 210 downwardly) and from the first configuration to the third configuration (e.g., by moving housing 210 upwardly). Additionally, the wellbore servicing tool 200 may be configured to transition from the third configuration (e.g., by moving housing 210 downwardly) back to the first configuration. Upon returning to the first configuration (having most-recently departed the third configuration), the servicing tool 200 may be configured such that the servicing tool 200 will again be cycled to the second configuration. As such, the servicing tool 200 may be continually cycled from the first configuration to the second, from the second configuration back to the first configuration, then from the first configuration to the third configuration, and, from the third configuration back to the first configuration. In an embodiment, the configuration of the servicing tool 200 at a given point during a servicing operation may be ascertainable by an operator, for example, by tracking the movement sequence of the tool (and thereby the related configuration thereof) and/or by noting fluid pumping pressures at a given flow rate via one or more flowpaths (e.g., axial flowbore 126). In other words, for a given flow rate, a relatively higher pressure would indicate that the tool is in the jetting configuration while a relatively lower pressure would indicate that the tool is in the mixing configuration due to the relative size of the flowpaths through the tool in each configuration.

In the embodiments of FIGS. 2 and 4, J-slot mandrel portion 245 comprises a continuous J-slot that provides for several axial positions for lugs 247 corresponding to axial positions of mandrel 280 within housing 210. Thus, inner external surface 246*c* of J-slot mandrel portion 245 allows for lugs 247 to engage the J-slot throughout an entire rotation of J-slot mandrel portion 245. The J-slot may slide axially and/or rotationally about the lugs 247 in response to frictional movement as described herein (e.g., an upward and/or downward longitudinal actuating force applied to effect movement of mandrel 280 relative to the housing 210). For ease of reference, interaction of the lugs 247 and J-slot is discussed in the context of relative movement, with the understanding that the lugs 247 may be relatively fixed in position within index pin housing portion 240 while the J-slot mandrel portion 245 is free to rotate and/or move longitudinally within the housing (or vice-versa in alternative embodiments).

In an embodiment, the transition between axial positions of mandrel 280 (e.g., first position, second position and third position) within housing 210 may be controlled by the physical interaction between lugs 247 and the J-slot mandrel portion 245. Lugs 247 control a range of axial movement of the housing 210 with respect to the mandrel 280 due to the slidable engagement between lugs 247 and notches 241, 242 and 243 of J-slot mandrel portion 245. The arrangement of J-slot mandrel portion 245 and lugs 247 allows J-slot mandrel portion 245 to move rotationally within housing 210 and lugs 247 to move through J-slot mandrel portion 245. For example, in response to frictional movement of the housing 210, lugs 247 are guided through J-slot mandrel portion 245 and into one of the notches 241, 242 or 243, thereby causing the rotational movement of the J-slot mandrel portion 245. For instance, lugs 247 may start at a first position where they are disposed within one of the short lower notches 241 of J-slot mandrel portion 245, wherein an actuating force is not being applied to housing 210.

Upon the application of an actuating force to housing 210 in the axially upward direction, wellbore servicing tool 200 may be transitioned from the first configuration to the second configuration via frictional movement (alternatively, as will be discussed herein, to the third configuration). As housing 210 is displaced axially upward due to the application of the actuating force, lugs 247 are displaced upward within J-slot mandrel portion 245 until they contact upper sloped edges 243*a*. Contact between edges 243*a* and lugs 247 cause J-slot mandrel portion 245 to rotate within housing 210 as lugs 247 slide axially along upper sloped edges 243*a* until lugs 247 become aligned with long upper notches 243, where lugs 247 then move further into the long upper notches 243 and come to a rest corresponding to the second position of mandrel 280, i.e., the second configuration of the wellbore servicing tool 200. The position of the DBAs 232 within the slots of the drag block assembly portion 230 may provide an axially spatial limit for the axial movement of the housing 210 with respect to the mandrel 280, and at the same time impedes the rotational movement of housing 210. For example, upon applying an actuating force for moving upwardly housing 210, when the DBAs 232 arrive at the lowermost position within the slots of the drag block assembly portion 230, the DBAs may prevent the housing 210 from moving further with respect to the mandrel 280, thereby causing the lugs 247 to stop moving within the long upper notches 243 and arrive in a location within the long upper notches 243 corresponding to the second configuration of the wellbore servicing tool 200. In an embodiment, the length of the slots of the drag block assembly portion are selected such that the drag blocks contact the upper and/or lower end of the slots prior to the lugs 247 contacting a corresponding end of the J-slot mandrel such that any load transferred to the tool via contact of the drag blocks with the casing/wellbore is substantially transferred to the housing via the drag blocks rather than to the J-slot mandrel via the lugs 247.

Upon the application of an actuating force to housing 210 in the axially downward direction, wellbore servicing tool 200 may be transitioned from the second configuration back to the first configuration via frictional movement. As housing 210 is displaced axially downward due to the application of the actuating force, lugs 247 are displaced downward within J-slot mandrel portion 245 until they contact lower sloped edges 241*a*. Contact between edges 241*a* and lugs 247 cause J-slot mandrel portion 245 to rotate within housing 210 as lugs 247 slide axially along lower sloped edges 241*a* until lugs 247 become aligned with short lower notches 241, where lugs 247 then move further into the short lower notches 241 and come to a rest corresponding to the first position of mandrel 280, i.e., the first configuration of the wellbore servicing tool 200. Upon applying an actuating force for moving downwardly housing 210, when the DBAs 232 arrive at the uppermost position within the slots of the drag block assembly portion 230, the DBAs may prevent the housing 210 from moving further with respect to mandrel 280, thereby causing the lugs 247 to stop moving within the short lower notches 241 and arrive in a location within the short lower notches 241 corresponding to the first configuration of the wellbore servicing tool 200.

Upon the application of an actuating force to housing 210 in the axially upward direction, wellbore servicing tool 200 may be transitioned from the first configuration to the third configuration via frictional movement (e.g., where the wellbore servicing tool 200 has most recently departed the second configuration). As housing 210 is displaced axially upward due to the application of the actuating force, lugs 247 are displaced upward within J-slot mandrel portion 245 until they contact upper sloped edges 242*a*. Contact between edges 242*a* and lugs 247 cause J-slot mandrel portion 245 to rotate within housing 210 as lugs 247 slide axially along upper sloped edges 242*a* until lugs 247 become aligned with short upper notches 242, where lugs 247 then move further into the short upper notches 242 and come to a rest corresponding to the third position of mandrel 280, i.e., the third configuration of the wellbore servicing tool 200. In such an embodiment, the overall cycling of housing 210 in an axially downward and upward motion results in lugs 247 of housing 210 being cycled between displacement in short lower notches 241, long upper notches 243, short lower notches 241, and short upper notches 242.

In some embodiments, wellbore servicing tool 200 in each of the three configurations (i.e., first, second, and third configurations) may be configured to allow for the recirculation of a fluid via an axial flowbore (e.g., flowpaths 263*c*, 261*c*, 256*a*, 226*c*, 222*a*, etc.) of the wellbore servicing tool 200. For example, in an embodiment, the servicing tool 200 may be transitioned to the recirculation mode. For example, in order to transition the servicing tool 200 to the recirculation mode, a pressure differential may be created between axial flowbore 126 and an exterior to the housing 210, particularly, such that the pressure within the axial flowbore 126 is less than the pressure exterior to the housing 210. Such a pressure differential may result from providing suction within axial flowbore 126, reverse circulating a fluid, allowing fluids exterior to the housing to create a fluid pressure (e.g., ambient wellbore and/or formation pressure), or combinations thereof.

In an embodiment, when the servicing tool 200 is in the first configuration, the pressure differential may cause the ball 264 to disengage seat 263 and be retained within chamber 262*b* while allowing fluid communication via flowpaths 263*c*, 261*c*, 253, 256*a*, 226*c*, 222*a* and 221*c* into the axial flowbore 126 of work string 112.

In an embodiment, when the servicing tool 200 is in the second configuration, the pressure differential may cause the ball 224 to disengage seat 223 and be retained within chamber 222*b*. During the recirculation mode of the second configuration, the ball 264 is retained within chamber 262*b* and not engaged in seat 263. The first ball sub-component 220 and the second ball sub-component 260, while in the recirculation mode of the second configuration, may allow for fluid communication via flowpaths 263*c*, 261*c*, 256*a*, 226*c*, 222*a* and 221*c* into the axial flowbore 126 of work string 112.

In an embodiment, when the servicing tool 200 is in the third configuration, the pressure differential may cause the ball 264 to disengage seat 263 and be retained within chamber 262*b* while allowing fluid communication via flowpaths 263*c*, 261*c*, 253, 256*a*, 226*c*, 222*a* and 221*c* into the axial flowbore 126 of work string 112.

In an embodiment, the wellbore servicing tool 200 may be transitioned from the recirculation mode of each configuration (i.e., first, second, and third configurations) to the forward circulation of fluid mode of each respective configuration. In such an embodiment, in order to transition wellbore servicing tool 200 from the recirculation mode to the forward circulation of fluid mode, pressure within axial flowbore 126 of work string 112 may be increased to such that the fluid pressure within the axial flowbore 126 is greater than the fluid pressure exterior to the servicing tool 200. As such, the wellbore servicing tool will arrive in the forward circulation of fluid mode of each respective configuration.

One or more of embodiments of a wellbore servicing system 100 comprising a wellbore servicing tool like wellbore servicing tool 200 having been disclosed, one or more embodiments of a wellbore servicing method employing such a wellbore servicing system 100 and/or such wellbore servicing tools 200 are also disclosed herein. In an embodiment, a wellbore servicing method may generally comprise the steps of positioning a wellbore servicing tool within a wellbore proximate to a zone of a subterranean formation, configuring the wellbore servicing tool for performing a jetting or perforating operation, communicating a wellbore servicing fluid at a pressure sufficient to form one or more perforations via the servicing tool, configuring the wellbore servicing tool for performing a mixing or fracturing operation, and communicating a wellbore servicing fluid and/or a component thereof at a rate and pressure sufficient to form or extend one or more fractures within the zone proximate to the servicing tool via the servicing tool.

In an additional embodiment, upon completion of the servicing operation with respect to a given zone, the servicing tool may be moved to another zone and the process of configuring the wellbore servicing tool for performing a jetting operation, communicating a wellbore servicing fluid at a pressure sufficient to form one or more perforations via the servicing tool, configuring the wellbore servicing tool for performing a mixing operation, and communicating a wellbore servicing fluid and/or a component thereof at a rate and pressure sufficient to form or extend one or more fractures within the zone proximate to the servicing tool via the servicing tool may be repeated, for as many formation zones as may be present within the subterranean formation.

In an embodiment, a wellbore servicing tool may be incorporated within a work string such as work string 112 of FIG. 1, and may be positioned within a wellbore (e.g., run in hole) such as wellbore 114. For example, in the embodiment of FIG. 1, work string 112 has incorporated therein a wellbore servicing tool 200 and is run in hole. Also in this embodiment, work string 112 is positioned within wellbore 114 such that the servicing tool 200 is proximate and/or substantially adjacent to formation zone 12. The wellbore servicing tool 200 comprising a DBA 232 is configured to slidably engage a casing string of a given size and configuration, such as casing 120, and will move via frictional movement within casing 120, as previously described herein. In an embodiment, wellbore servicing tool 200 may be positioned within wellbore 114 (e.g., run in hole) in the first configuration. In an embodiment, servicing tool 200 is configured in the first configuration so as to transition to the second, jetting configuration upon actuation.

Additionally, in an embodiment, the wellbore servicing tool 200 may be employed and/or function as a casing collar locator (CCL), for example, a mechanical CCL. For example, the wellbore servicing tool 200 may be used to confirm the depth and/or position of the wellbore servicing tool 200 within the wellbore through an interaction with one or more know features (which may serve as reference points) at know depths/positions within the wellbore 114. For example, in such an embodiment, the DBAs 232 exert a force against the casing 120, thereby allowing features or elements of the casing 120 to be sensed (e.g., through the interaction with the DBAs 232) by the wellbore servicing tool 200 as the wellbore servicing tool 200 is moved through the casing 120 (e.g., run-in). For example, the interaction between the DBAs 232 and the casing 120 may result in a "bump" or "tug" on the work string 112 which may be sensed at the surface. In such an embodiment, the position of the wellbore servicing tool 200 may be determined by counting the number of interacts and/or by monitoring for a particular interaction. Such features within the casing 120 may include joints in the casing 120, collars, changes in casing diameter, slots, lugs, or the like. Therefore, the wellbore servicing tool 200 may allow an operator to determine the position (e.g., depth) of the wellbore servicing tool 200 within the wellbore 114, and thereby further aid in the performance of one or more wellbore servicing operations as disclosed herein.

In some embodiments, for example, in the embodiments of FIGS. 1 and 2, the wellbore may be cased with a casing such as casing 120. Also, in such an embodiment, the casing 120 may be secured in place with cement, for example, such that a cement sheath (e.g., cement 122) surrounds the casing 120 and fills the void space between the casing 120 and the walls of the wellbore 114. Although the embodiments of FIGS. 1 and 2 illustrate, and the following disclosure may reference, a cased, cemented wellbore, one of skill in the art will appreciate that the methods disclosed herein may be similarly employed in an uncased wellbore or a cased, uncemented wellbore, for example, where the casing is secured utilizing a packer or the like.

In an embodiment, the zones of the subterranean formation may be serviced beginning with the zone that is furthest down-hole (e.g., in the embodiment of FIG. 1, formation zone 12) moving progressively upward toward the furthest up-hole zone (e.g., in the embodiment of FIG. 1, formation zone 2). In alternative embodiments, the zones of the subterranean formation may be serviced in any suitable order, as will be appreciated by one of skill in the art upon viewing this disclosure.

In an embodiment, once the work string comprising a wellbore servicing tool has been positioned within the wellbore, the wellbore servicing tool may be prepared for the communication of a fluid to the wellbore at a pressure suitable for a jetting operation. Referring to FIGS. 1 and 2, in such an embodiment, servicing tool 200, which is positioned proximate and/or substantially adjacent to the first zone to be serviced (e.g., formation zone 12), is transitioned from the first (RIH) configuration (e.g., FIG. 2B) to the second (jetting) configuration (e.g., FIG. 2C), by applying an upward actuating force that causes a frictional movement, as previously described herein.

In an embodiment, with the servicing tool 200 in the second (jetting) configuration, a wellbore servicing fluid may be communicated, for example, via axial flowbore 126 of work string 112, through ports 130 (e.g., high-pressure ports 130), and into the wellbore 114 (for example, as illustrated in FIG. 1). Also, in an embodiment, ports 130 may be fitted with one or more pressure-altering devices (e.g., nozzles, erodible nozzles, or the like) to increase the dynamic pressure of fluid emitted from ports 130. In the second configuration of tool 200 (for example, as illustrated in FIGS. 1 and 2C), the flow of servicing fluid is restricted between axial flowbore 126 and openings 252, as previously described herein. Nonlimiting examples of such a suitable wellbore servicing fluid include but are not limited to a perforating or hydrajetting fluid and the like, or combinations thereof. The wellbore servicing fluid may be communicated at a suitable rate and pressure for a suitable duration. For example, the wellbore servicing fluid may be communicated at a rate and/or pressure sufficient to create one or more perforations and/or to initiate fluid pathways within a casing string, a cement sheath, and/or the subterranean formation 102 and/or a zone thereof.

In an embodiment, when a desired amount of the servicing fluid has been communicated, for example, sufficient to create a desired number of perforations, an operator may cease the communication of fluid, for example, by ceasing to pump the servicing fluid into work string 112. The wellbore servicing tool 200 may be transitioned into the third (mixing or fracturing) configuration (e.g., FIG. 2D), by applying a downward followed by an upward actuating force to the work string 112 that causes frictional movement, as previously described herein.

In an embodiment, with the servicing tool in the third (mixing or fracturing) configuration, a wellbore servicing fluid may be communicated, for example, from axial flowbore 126, through openings 252, and to the proximal subterranean formation zone 12 at a relatively higher volume but lower dynamic pressure than through ports 130 when in the jetting configuration. Nonlimiting examples of a suitable wellbore servicing fluid include but are not limited to a fracturing fluid, an acidizing fluid, the like, or combinations thereof. In an additional embodiment, the wellbore servicing fluid may also comprise a composite fluid comprising a first component and a second component, where the first component may be displaced downhole through a first flowpath (e.g., axial flowbore 126 of work string 112) and the second component may be displaced downhole through a second flowpath (e.g., an annular space 140 surrounding the work string 112). In such an embodiment, the first component and second component may be mixed within the wellbore prior to and/or substantially contemporaneously with movement into the subterranean formation 102 (e.g., via a fracture). Composite fluids and methods of utilizing the same in the performance of a wellbore servicing operation are disclosed in U.S. application Ser. No. 12/358,079, which is incorporated herein by reference in its entirety, for all purposes. The wellbore servicing fluid may be communicated at a suitable rate and volume for a suitable duration. For example, the wellbore servicing fluid may be communicated at a rate and/or pressure sufficient to initiate and/or extend a fluid pathway (e.g., a fracture) within the subterranean formation 102 and/or a zone thereof (e.g., one of zones 2, 4, 6, 8, 10, or 12).

In an embodiment, when a desired amount of the servicing fluid and/or composite fluid has been communicated to formation zone 12, an operator may cease the communication of fluid to formation (e.g., formation zone 12). In an embodiment, upon completion of the servicing operation with respect to a given zone, the servicing tool may be reconfigured (e.g., from the third configuration to the first configuration) and/or removed to another zone and the process of configuring the wellbore servicing tool for performing a jetting operation, communicating a wellbore servicing fluid at a pressure sufficient to form one or more perforations via the servicing tool, configuring the wellbore servicing tool for performing a mixing or fracturing operation, and communicating a wellbore servicing fluid and/or a component thereof at a rate and pressure sufficient to form or extend one or more fractures within the zone proximate to the servicing tool via the servicing tool, may be repeated with respect the relatively more up-hole formation zones 2, 4, 6, 8 and 10. In an embodiment, wellbore servicing tool 200 may be displaced uphole until it is proximal formation zone 10, wherein this process may be repeated. In such an embodiment, the operator may choose to isolate a relatively more downhole zone (e.g., zone 12) that has already been serviced, for example, for the purpose of restricting fluid communication into that zone. In such an embodiment, such isolation may be provided via a sand and/or proppant plug upon the termination of the servicing operation with respect to each zone. In an alternative embodiment, such isolation may be provided via a mechanical plug or packer (e.g., a fracturing plug). For example, in such an embodiment, such a mechanical plug or packer may be set, unset, and reset via interaction with the wellbore servicing tool 200 (e.g., via a mating assembly at the downhole end of the servicing tool 200), a wireline tool, a fishing neck tool, or the like. In an embodiment, such a mechanical plug may be coupled/attached to the guiding device portion 270.

Referring to FIGS. 1 and 2, in an embodiment an operator may optionally transition wellbore servicing tool 200 into a recirculation mode, as previously described herein. Pressure may be decreased within work string 112 through the cessation of the displacement of fluid into work string 112 from the surface 104. In the recirculation mode, formation fluids from zone 12 may be communicated to the axial flowbore 126 of work string 112 through axial flowbores of mandrel 280 and/or housing 210 (e.g., flowpaths 263*c*, 261*c*, 256*a*, 226*c*, 222*a*, etc.). The process disclosed herein may thereafter be repeated with respect one or more of the up-hole formation zones 2, 4, 6, 8 and 10.

In an embodiment, a wellbore servicing tool such as servicing tool 200, a wellbore servicing system such as wellbore servicing system 100 comprising a wellbore servicing tool such as servicing tool 200, a wellbore servicing method employing such a wellbore servicing system 100 and/or such a wellbore servicing system 200, or combinations thereof may be advantageously employed in the performance of a wellbore servicing operation. For example, as disclosed herein, a wellbore servicing tool such as servicing tool 200 may allow an operator to cycle a servicing tool as disclosed herein, for example, servicing tool 200, between a jetting mode and a mixing or fracturing mode without the need to communicate an obturating member (e.g., a ball, dart and the like) from the surface 104 to the servicing tool 200 and without the need to remove the servicing tool 200 from the wellbore (e.g., the servicing tool 200 is "non-ball-drop actuated"). The ability to transition servicing tool 200 from a jetting mode to a mixing or fracturing mode without communicating an obturating member and without removing the tool from the wellbore may reduce the total time needed to perform the wellbore stimulation procedure.

Also, the servicing tool 200 does not rely on introducing and landing an obturating member on a seat within the tool so as to transition the tool from a given configuration to another configuration, and, therefore does not present the possibility of obturating members failing to land on their associated seats, due to erosion or other factors.

In some embodiments, the wellbore servicing tool 200 may be advantageously transitioned into a recirculating mode during the wellbore servicing operation, irrespective of the configuration of the wellbore servicing tool 200 and the operational sequence. As such, the wellbore servicing tool 200 may operate as a self-cleaning tool, and may display less sand blockage than conventional servicing tools.

Additionally, the wellbore servicing tool 200 does not rely extensively on pressure parameters for performing wellbore servicing operations, as the tool transition between configurations is mechanically actuated, which is a simpler method of actuation when compared to conventional tool actuating methods (e.g., pressure actuation).

As such, the servicing tool 200 may be operated in a wellbore servicing operation as disclosed herein with improved reliability in comparison to conventional servicing tools. Additional advantages of the wellbore servicing tool 200 and methods of using same may be apparent to one of skill in the art viewing this disclosure.

ADDITIONAL DISCLOSURE

The following are nonlimiting, specific embodiments in accordance with the present disclosure:

A first embodiment, which is a wellbore servicing system comprising:

a casing string disposed within a wellbore;

a work string at least partially disposed within the casing string and having a wellbore servicing tool incorporated therein, wherein the wellbore servicing tool is selectively transitionable between a jetting configuration and a mixing configuration, wherein the wellbore servicing tool is configured to transition between the jetting configuration and the mixing configuration via contact between the wellbore servicing tool and the casing upon movement of the work string upwardly within the casing string, upon movement of the work string downwardly within the casing string, or by combinations thereof.

A second embodiment, which is the wellbore servicing system of the first embodiment, wherein the wellbore servicing tool is configured to transition:

first, from an indexing configuration to the jetting configuration;

second, from the jetting configuration to the indexing configuration;

third, from the indexing configuration to the mixing configuration; and fourth, from the mixing configuration to the indexing configuration.

A third embodiment, which is the wellbore servicing system of the second embodiment, wherein the wellbore servicing tool is configured to transition from the indexing configuration to the jetting configuration upon movement of the work string upwardly within the casing string, wherein the wellbore servicing tool is configured to transition from the jetting configuration to the indexing configuration upon movement of the work string downwardly within the casing string, wherein the wellbore servicing tool is configured to transition from the indexing configuration to the mixing configuration upon movement of the work string upwardly within the casing string, and wherein the wellbore servicing tool is configuration to transition from the mixing configuration to the indexing configuration upon movement of the work string downwardly within the casing string.

A fourth embodiment, which is the wellbore servicing system of one of the second through the third embodiments, wherein the wellbore servicing tool comprises:

a housing generally defining an axial flowbore and comprising:

one or more high-pressure ports; and one or more low-pressure ports;

a mandrel slidably positioned within the housing; and one or more drag block assemblies, wherein the one or more drag block assemblies are configured to impart longitudinal movement to the mandrel via said contact between the wellbore servicing tool and the casing.

A fifth embodiment, which is the wellbore servicing system of the fourth embodiment, wherein, when the wellbore servicing tool is in the jetting configuration, the mandrel blocks a route of fluid communication via the one or more low-pressure ports, and wherein, when the wellbore servicing tool is in the mixing configuration, the mandrel does not block the route of fluid communication via the one or more low-pressure ports.

A sixth embodiment, which is the wellbore servicing system of one of the fourth through the fifth embodiments, wherein the movement of the mandrel relative to the housing is controlled by a J-slot.

A seventh embodiment, which is the wellbore servicing system of the sixth embodiment, wherein the J-slot comprises:

a slot circumferentially disposed about at least a portion of the mandrel; and a lug extending radially inward from the housing.

An eighth embodiment, which is the wellbore servicing system of one of the second through the seventh embodiments, wherein the wellbore servicing tool is configured to provide an upward route of fluid communication therethrough in the indexing configuration, in the jetting configuration, and in the mixing configuration.

A ninth embodiment, which is the wellbore servicing system of one of the first through the eighth embodiments, wherein the wellbore servicing tool is configured to transition between the jetting configuration and the mixing configuration without communicating an obturating member to the wellbore servicing apparatus, without removing an obturating member from the wellbore servicing apparatus, or combinations thereof.

A tenth embodiment, which is the wellbore servicing system of one of the fourth through the sixth embodiments, wherein the one or more drag block assemblies are configured to provide said contact between the wellbore servicing tool and the casing.

An eleventh embodiment, which is a wellbore servicing tool comprising:

a housing generally defining an axial flowbore and comprising:

one or more high-pressure ports; and one or more low-pressure ports;

a mandrel slidably positioned within the housing; and one or more drag block assemblies, wherein the one or more drag block assemblies are configured to impart longitudinal movement to the mandrel via contact with a wellbore or casing surface, wherein, when the wellbore servicing tool is in a jetting configuration, the mandrel blocks a route of fluid communication via the one or more low-pressure ports, wherein, when the wellbore servicing tool is in a mixing configuration, the mandrel does not block the route of fluid communication via the one or more low-pressure ports, and wherein the wellbore servicing tool is configured to transition between the jetting configuration and the mixing configuration upon upward movement of the housing relative to the casing string, upon downward movement of the housing relative to the casing string, or by combinations thereof.

A twelfth embodiment, which is the wellbore servicing system of the eleventh embodiment, wherein the wherein the wellbore servicing tool is configured to transition between the jetting configuration and the mixing configuration without communicating an obturating member to the wellbore servicing apparatus, without removing an obturating member from the wellbore servicing apparatus, or combinations thereof.

A thirteenth embodiment, which is a wellbore servicing method comprising:

positioning a work string having a wellbore servicing tool incorporated therein within a casing string disposed within a wellbore, wherein the work string is positioned such that the wellbore servicing tool is proximate to a first subterranean formation zone;

configuring the wellbore servicing tool via contact with the casing string to deliver a jetting fluid, wherein configuring the wellbore servicing tool comprises moving the work string upwardly with respect to the casing, moving the work string downwardly with respect to the casing, or combinations thereof;

communicating the jetting fluid via the wellbore servicing tool;

configuring the wellbore servicing tool via contact with the casing string to deliver at least a portion of a fracturing fluid, wherein configuring the wellbore servicing tool comprises moving the work string upwardly with respect to the casing, moving the work string downwardly with respect to the casing, or combinations thereof; and communicating at least a portion of the fracturing fluid via the wellbore servicing tool.

A fourteenth embodiment, which is the method of the thirteenth embodiment, wherein communicating the jetting fluid via the wellbore servicing tool forms a perforation within the casing string, a cement sheath surrounding the casing string, a wellbore wall, or combinations thereof.

A fifteenth embodiment, which is the method of one of the thirteenth through the fourteenth embodiments, wherein communicating at least a portion of the fracturing fluid via the wellbore servicing tool comprises communicating a first component fluid of the fracturing fluid via a first route of fluid communication, wherein the first route of fluid communication comprises a flowbore of the work string.

A sixteenth embodiment, which is the method of the fifteenth embodiment, further comprising communicating a second component fluid of the fracturing fluid via a second route of fluid communication, wherein the second route of fluid communication comprises an annular space between the work string and the casing string.

A seventeenth embodiment, which is the method of one of the thirteenth through the sixteenth embodiments, wherein communicating at least a portion of the fracturing fluid via the wellbore servicing tool initiates and/or extends a fracture within the first subterranean formation zone.

An eighteenth embodiment, which is the method of one of the thirteenth through the seventeenth embodiments, wherein the wellbore servicing tool comprises:

a housing generally defining an axial flowbore and comprising:

one or more high-pressure ports; and one or more low-pressure ports;

a mandrel slidably positioned within the housing;

one or more drag block assemblies contacting an inner bore surface of the casing string; and a J-slot configured to control the movement of the mandrel relative to the housing.

A nineteenth embodiment, which is the method of the eighteenth embodiment, wherein the wellbore servicing tool is configured to transition:

first, from an indexing configuration to the jetting configuration;

second, from the jetting configuration to the indexing configuration;

third, from the indexing configuration to the mixing configuration; and fourth, from the mixing configuration to the indexing configuration.

A twentieth embodiment, which is the wellbore servicing system of the nineteenth embodiment, wherein transitioning the wellbore servicing tool from the indexing configuration to the jetting configuration comprises moving of the work string upwardly within the casing string, wherein transitioning the wellbore servicing tool from the jetting configuration to the indexing configuration comprises moving the work string downwardly within the casing string, wherein transitioning the wellbore servicing tool from the indexing configuration to the mixing configuration comprises moving the work string upwardly within the casing string, and wherein transitioning wellbore servicing tool from the mixing configuration to the indexing configuration comprises moving the work string downwardly within the casing string.

A twenty-first embodiment, which is the wellbore servicing system of one of the thirteenth through the twentieth embodiments, further comprising determining a position of the wellbore servicing tool within the wellbore, wherein the position of the wellbore servicing tool is determined via the contact with the casing string.

A twenty-second embodiment, which is the wellbore servicing system of the twenty-first embodiment, wherein the wellbore servicing tool interacts with one or more features of the casing string.

A twenty-third embodiment, which is a wellbore servicing system comprising:

a casing string disposed within a wellbore;

a work string at least partially disposed within the casing string and having a wellbore servicing tool incorporated therein, wherein the wellbore servicing tool comprises:

a housing generally defining an axial flowbore and comprising:

one or more high-pressure ports; and one or more low-pressure ports;

a mandrel slidably positioned within the housing; and one or more drag block assemblies contacting an inner bore surface of the casing string, wherein the one or more drag block imparts longitudinal movement to the mandrel, wherein, when the wellbore servicing tool is in a jetting configuration, the mandrel blocks a route of fluid communication via the one or more low-pressure ports, wherein, when the wellbore servicing tool is in a mixing configuration, the mandrel does not block the route of fluid communication via the one or more low-pressure ports, and wherein the wellbore servicing tool transitions between the jetting configuration and the mixing configuration upon upward movement of the housing relative to the casing string, upon downward movement of the housing relative to the casing string, or by combinations thereof.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing system comprising:

a casing string disposed within a wellbore;

a work string at least partially disposed within the casing string; and a wellbore servicing tool incorporated into the work string, the wellbore servicing tool comprising:

a housing generally defining an axial flowbore;

a mandrel positioned within, and adapted to slide axially in relation to, the housing; and one or more drag block assemblies connected to, and adapted to move axially together with, the mandrel;

wherein the wellbore servicing tool is selectively transitionable between a jetting configuration and a mixing configuration;

wherein the wellbore servicing tool is configured to transition between the jetting configuration and the mixing configuration via contact between the wellbore servicing tool and the casing string, upon movement of the work string upwardly within the casing string, upon movement of the work string downwardly within the casing string, or by combinations thereof; and wherein the one or more drag block assemblies are configured to provide said contact between the wellbore servicing tool and the casing string, thereby imparting longitudinal movement to the mandrel in relation to the housing.

2. The wellbore servicing system of claim 1, wherein the wellbore servicing tool is configured to transition:

first, from an indexing configuration to the jetting configuration;

second, from the jetting configuration to the indexing configuration;

third, from the indexing configuration to the mixing configuration; and fourth, from the mixing configuration to the indexing configuration.

3. The wellbore servicing system of claim 2, wherein the wellbore servicing tool is configured to transition from the indexing configuration to the jetting configuration upon movement of the work string upwardly within the casing string, wherein the wellbore servicing tool is configured to transition from the jetting configuration to the indexing configuration upon movement of the work string downwardly within the casing string, wherein the wellbore servicing tool is configured to transition from the indexing configuration to the mixing configuration upon movement of the work string upwardly within the casing string, and wherein the wellbore servicing tool is configuration to transition from the mixing configuration to the indexing configuration upon movement of the work string downwardly within the casing string.

4. The wellbore servicing system of claim 2, wherein the housing comprises:

one or more high-pressure ports; and one or more low-pressure ports.

5. The wellbore servicing system of claim 4, wherein, when the wellbore servicing tool is in the jetting configuration, the mandrel blocks a route of fluid communication via the one or more low-pressure ports, and wherein, when the wellbore servicing tool is in the mixing configuration, the mandrel does not block the route of fluid communication via the one or more low-pressure ports.

6. The wellbore servicing system of claim 4, wherein the movement of the mandrel relative to the housing is controlled by a J-slot.

7. The wellbore servicing system of claim 6, wherein the J-slot comprises:

a slot circumferentially disposed about at least a portion of the mandrel; and a lug extending radially inward from the housing.

8. The wellbore servicing system of claim 2, wherein the wellbore servicing tool is configured to provide an upward route of fluid communication therethrough in the indexing configuration, in the jetting configuration, and in the mixing configuration.

9. The wellbore servicing system of claim 1, wherein the wellbore servicing tool is configured to transition between the jetting configuration and the mixing configuration without communicating an obturating member to the wellbore servicing apparatus, without removing an obturating member from the wellbore servicing apparatus, or combinations thereof.

10. A wellbore servicing tool comprising:

a housing generally defining an axial flowbore and comprising:

one or more high-pressure ports; and one or more low-pressure ports;

a mandrel positioned within, and adapted to slide axially in relation to, the housing; and one or more drag block assemblies connected to, and adapted to move axially together with, the mandrel, wherein the one or more drag block assemblies are configured to impart longitudinal movement to the mandrel via contact with a wellbore or casing string, wherein, when the wellbore servicing tool is in a jetting configuration, the mandrel blocks a route of fluid communication via the one or more low-pressure ports, wherein, when the wellbore servicing tool is in a mixing configuration, the mandrel does not block the route of fluid communication via the one or more low-pressure ports, and wherein the wellbore servicing tool is configured to transition between the jetting configuration and the mixing configuration upon upward movement of the housing relative to the casing string, upon downward movement of the housing relative to the casing string, or by combinations thereof.

11. The wellbore servicing tool of claim 10, wherein the wellbore servicing tool is configured to transition between the jetting configuration and the mixing configuration without communicating an obturating member to the wellbore servicing tool, without removing an obturating member from the wellbore servicing tool, or combinations thereof.

12. A wellbore servicing method comprising:

positioning a work string having a wellbore servicing tool incorporated therein within a casing string disposed within a wellbore, wherein the work string is positioned such that the wellbore servicing tool is proximate to a first subterranean formation zone, the wellbore servicing tool comprising:

a housing generally defining an axial flowbore;

a mandrel positioned within, and adapted to slide axially in relation to, the housing; and one or more drag block assemblies connected to, and adapted to move axially together with, the mandrel;

configuring the wellbore servicing tool via contact with the casing string to deliver a jetting fluid, wherein configuring the wellbore servicing tool comprises moving the work string upwardly with respect to the casing string, moving the work string downwardly with respect to the casing string, or combinations thereof;

communicating the jetting fluid via the wellbore servicing tool;

configuring the wellbore servicing tool via contact with the casing string to deliver at least a portion of a fracturing fluid, wherein configuring the wellbore servicing tool comprises moving the work string upwardly with respect to the casing string, moving the work string downwardly with respect to the casing string, or combinations thereof; and communicating at least a portion of the fracturing fluid via the wellbore servicing tool;

wherein the one or more drag block assemblies are configured to provide said contact between the wellbore servicing tool and the casing string, thereby imparting longitudinal movement to the mandrel in relation to the housing.

13. The method of claim 12, wherein communicating the jetting fluid via the wellbore servicing tool forms a perforation within the casing string, a cement sheath surrounding the casing string, a wellbore wall, or combinations thereof.

14. The method of claim 12, wherein communicating at least a portion of the fracturing fluid via the wellbore servicing tool comprises communicating a first component fluid of the fracturing fluid via a first route of fluid communication, wherein the first route of fluid communication comprises a flowbore of the work string.

15. The method of claim 14, further comprising communicating a second component fluid of the fracturing fluid via a second route of fluid communication, wherein the second route of fluid communication comprises an annular space between the work string and the casing string.

16. The method of claim 12, wherein the housing comprises:

one or more high-pressure ports; and one or more low-pressure ports;

and wherein the wellbore servicing tool further comprises a J-slot configured to control the movement of the mandrel relative to the housing.

17. The method of claim 16, wherein the wellbore servicing tool is configured to transition:

first, from an indexing configuration to the jetting configuration;

second, from the jetting configuration to the indexing configuration;

third, from the indexing configuration to the mixing configuration; and fourth, from the mixing configuration to the indexing configuration.

18. The wellbore servicing method of claim 17, wherein transitioning the wellbore servicing tool from the indexing configuration to the jetting configuration comprises moving of the work string upwardly within the casing string, wherein transitioning the wellbore servicing tool from the jetting configuration to the indexing configuration comprises moving the work string downwardly within the casing string, wherein transitioning the wellbore servicing tool from the indexing configuration to the mixing configuration comprises moving the work string upwardly within the casing string, and wherein transitioning wellbore servicing tool from the mixing configuration to the indexing configuration comprises moving the work string downwardly within the casing string.

19. The wellbore servicing method of claim 12, further comprising determining a position of the wellbore servicing tool within the wellbore, wherein the position of the wellbore servicing tool is determined via the contact with the casing string.

* * * * *